US007950913B2

(12) United States Patent
Suefuji et al.

(10) Patent No.: US 7,950,913 B2
(45) Date of Patent: May 31, 2011

(54) SEAL SYSTEM AND SCROLL TYPE FLUID MACHINE

(75) Inventors: Kazutaka Suefuji, Kawasaki (JP); Kiminori Iwano, Yokohama (JP); Yuji Komai, Tokyo (JP); Koji Fukui, Machida (JP); Susumu Sakamoto, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 595 days.

(21) Appl. No.: 12/071,678

(22) Filed: Feb. 25, 2008

(65) Prior Publication Data

US 2008/0206083 A1 Aug. 28, 2008

(30) Foreign Application Priority Data

Feb. 28, 2007 (JP) ..... 2007-050577

(51) Int. Cl.
*F04C 15/00* (2006.01)
*F04C 2/00* (2006.01)

(52) U.S. Cl. ..... 418/144; 418/55.4; 418/55.5; 418/57; 418/104; 418/152; 418/178; 277/549; 277/562

(58) Field of Classification Search ..... 418/55.1–55.6, 418/57, 104, 144, 152, 178, 179; 277/549, 277/562, 648, 649, 946
See application file for complete search history.

(56) References Cited

U.S. PATENT DOCUMENTS 6,592,345 B2 * 7/2003 Suefuji et al. ..... 418/55.4
7,458,788 B2 * 12/2008 Iwano et al. ..... 418/55.5

FOREIGN PATENT DOCUMENTS

DE 102004021662 A1 * 12/2005
JP 1-250675 10/1989
JP 2002054583 A * 2/2002
JP 2004-301093 10/2004
JP 2005-061304 3/2005
JP 2007009757 A * 1/2007

* cited by examiner

*Primary Examiner* — Theresa Trieu
(74) *Attorney, Agent, or Firm* — Crowell & Moring LLP

(57) ABSTRACT

In a seal system for a scroll type fluid machine, a seal mechanism is provided between a backpressure plate and a holder, so as to surround an orbiting backpressure chamber. The seal member comprises a seal attachment groove, a seal member and a Y-shaped packing. The seal attachment groove is stepped on its outer circumference to define a shallow bottom portion. The seal member includes, on its outer circumference side, a cutout portion matching the shallow bottom portion. The Y-shaped packing is disposed between a deep groove peripheral wall of the seal attachment groove and the cutout portion of the seal member, and a backpressure chamber is defined on a reverse surface side of the seal member. By this arrangement, a slide surface of the seal member can be larger than an effective area of the backpressure side of the seal member. Thereby it is possible to reduce a difference between a load Ff acting on the slide surface and a load Fb acting on the reverse surface.

22 Claims, 18 Drawing Sheets

SEAL SYSTEM AND SCROLL TYPE FLUID MACHINE

BACKGROUND OF THE INVENTION

The present invention relates to a seal system comprising an annular groove and a seal member that is fittedly inserted in the groove, and to a scroll type fluid machine that is provided with a seal mechanism comprising such a groove and seal member.

Generally, a scroll type fluid machine comprises a fixed scroll and an orbiting scroll which face each other, and each scroll includes a spiral wrap portion that is erected from a bottom surface of an end plate of the scroll. The two scrolls are disposed to face each other so that the two wrap portions overlap to define a plurality of sealed chambers. Therefore, when the orbiting scroll is driven to perform an orbiting motion relative to the fixed scroll, the sealed chambers successively contract or expand, thereby compressing or expanding air, catalytic gas or the like.

As a conventional art, there is known, for example, a seal mechanism that is provided on a periphery side of a wrap portion of a fixed scroll for preventing leakage of air or the like. (For example, refer to Japanese Patent Application Public Disclosures No. 2005-61304, 2004-301093, H01-250675.) This conventional seal mechanism comprises an annular groove provided on the periphery side so as to surround the warp portion of the fixed scroll, and an annular seal member fittedly inserted in the groove.

SUMMARY OF THE INVENTION

Conventionally, in a typical seal mechanism, each of a groove and a seal member has a rectangular cross section. In such a seal mechanism, when a pressure difference between pressures on a high pressure side and a low pressure side is larger than or equal to a certain level, the seal member, which has a rectangular cross section and is disposed in the groove having a rectangular cross section, is pressed against a facing orbiting scroll with a heavy pressing load, as a result of which serious friction loss and abrasion is caused.

With the aim of solving this problem, the above-mentioned Japanese Patent Application Public Disclosure No. 2005-61304 discloses a seal mechanism in which only a seal member is formed to have a stepped cross section, so as to reduce a pressing load. However, in this invention also, a surface pressure of the seal member still consists of a differential pressure between a pressure on a reverse surface of the seal member on a bottom side of a groove and a pressure on a front surface which is a slide surface relative to an orbiting scroll. Therefore, the surface pressure of the seal member cannot be reduced sufficiently to extend a lifetime of the seal member.

Japanese Patent Application Public Disclosure No. 2004-301093 discloses a seal mechanism including a seal member provided with a pressure introduction hole by which pressures on a reverse surface and a front surface of the seal member are balanced. However, this invention has a problem in that the seal member and the like have a complicated configuration and thereby require additional processing, resulting in an increase in manufacturing costs.

Japanese Patent Application Public Disclosure No. H01-250675 discloses a seal mechanism for sealing an inner circumferential surface of a cylinder (cylinder surface), by which it becomes possible to reduce a load on a slide surface of a seal member. In this invention, a pressure on the slide surface of the seal member with the cylinder is reduced by partially introducing a pressure of a low pressure side into an inner circumferential surface of the seal member, thereby reducing an area on which a pressure of a high pressure side acts. While this invention succeeds in reducing a pressure acting on the slide surface of the seal member with the cylinder, it requires introduction of pressure of the low pressure side into a significant area of a peripheral wall of the low pressure side of the seal groove, which is originally supposed to receive pressures distributed in the range of the low pressure to the high pressure. As a result, it is not possible to prevent the seal member from being pressed from the high pressure side toward the low pressure side by a stronger force, and therefore the seal member is brought into frictional contact with the peripheral wall of the seal groove, whereby movement of the seal member is restrained and abrasion of the seal member is aggravated by friction produced between the seal member and the peripheral wall.

The present invention has been contrived in consideration of the problem of the above-mentioned conventional arts, and an object thereof is to provide a seal system and a scroll type fluid machine in which a surface pressure of a seal member is reduced to improve durability of the seal member.

In order to achieve the forgoing and other objects, the present invention provides a seal system comprising: a member on one side and a member on the other side which are disposed to face each other and one or both of which perform a sliding motion; an annular groove provided on a slide surface of the member on the other side, the slide surface with which the member on the other side slides on the member on the one side; and an annular seal member fittedly inserted in the groove and having a surface used as a slide surface, wherein the slide surface of the seal member contacts a slide surface of the member on the one side on their flat surfaces; a high pressure side and a low pressure side are defined; a leak preventer for preventing a pressure of the high pressure side from leaking into the low pressure side is disposed between the seal member and the groove; the leak preventer, a bottom portion side of the groove and the seal member define a backpressure chamber in communication with the high pressure side; and when the seal member is in a used state, a contact area of the slide surface of the seal member with the member on the one side is large compared to an effective area of the backpressure side of the seal member which pushes the seal member toward the member on the one side.

Further, the present invention provides A seal system comprising: a member on one side and a member on the other side which are disposed to face each other and one or both of which perform a sliding motion; an annular groove provided on a slide surface of the member on the other side, the slide surface with which the member on the other side slides on the member on the one side; and an annular seal member fittedly inserted in the groove and having a surface used as a slide surface, wherein the slide surface of the seal member contacts a slide surface of the member on the one side on their flat surfaces; a high pressure side and a low pressure side are defined; a leak preventer for preventing a pressure of the high pressure side from leaking into the low pressure side is disposed between the seal member and the groove so as to be positioned on the low pressure side on an inner circumference side or an outer circumference side of the seal member; the leak preventer, a bottom portion side of the groove and the seal member define a backpressure chamber in communication with the high pressure side; and when the seal member is in a used state, the slide surface of the seal member extends radially toward the low pressure side relative to a boundary of the low pressure side of the backpressure chamber.

The slide surface of the seal member may be configured such that the contact area of the slide surface of the seal member with the member on the one side increases due to abrasion of the slide surface of the seal member.

The slide surface of the seal member may include a portion which is gradually spaced apart relative to the member on the one side from the slide surface of the seal member toward the low pressure side.

The seal member may include, on the high pressure side of the slide surface thereof, a high-pressure-side stepped portion facing the member on the one side in a spaced-apart relationship with the member on the one side.

In the seal system, a shallow bottom portion having a lesser depth than that of the bottom portion of the groove may be formed on the low pressure side of the groove; a cutout portion configured to match the shallow bottom portion may be formed on the seal member; and the leak preventer may be disposed between the cutout portion of the seal member and a low-pressure-side deep groove peripheral wall positioned between the bottom portion and the shallow bottom portion of the groove.

In the seal system, a low-pressure-side shallow groove peripheral wall positioned between the shallow bottom portion of the groove and an opening may be formed; and a first gap defined between the seal member and the low-pressure-side deep groove peripheral wall of the groove may be larger than a second gap defined between the seal member and the low-pressure-side shallow groove peripheral wall of the groove.

A raised or gullet portion extending in a direction toward the bottom portion of the groove may be formed on a portion of the seal member, the portion facing the second gap.

Further, the present invention provides a scroll type fluid machine wherein: a wrap portion of a scroll on one side and a wrap portion of a scroll on the other side overlap to define a sealed chamber; fluid drawn or introduced from outside is compressed or expanded while an orbiting motion is performed; a seal mechanism comprises an annular groove provided on a periphery side of the wrap portion of the scroll on the other side, and an annular seal member fittedly inserted in the groove and having a surface used as a slide surface; in the seal mechanism, the slide surface of the seal member contacts a slide surface of the scroll on the one side on their flat surfaces, and a high pressure side and a low pressure side are defined; a leak preventer for preventing a pressure of the high pressure side from leaking into the low pressure side is disposed between the seal member and the groove so as to be positioned on the low pressure side on an inner circumference side or an outer circumference side of the seal member; the leak preventer, a bottom portion side of the groove and the seal member define a backpressure chamber in communication with the high pressure side; and when the seal member is in a used state, the slide surface of the seal member extends radially toward the low pressure side relative to a boundary of the low pressure side of the backpressure chamber.

Further, the present invention provides a scroll type fluid machine comprising: a casing; a fixed scroll disposed in the casing and having a spiral wrap portion extending from a surface of an end plate thereof; and an orbiting scroll disposed so as to face the fixed scroll and having a wrap portion which extends from a surface of an end plate thereof and overlaps with the wrap portion of the fixed scroll to define a plurality of sealed chambers therebetween, wherein a backpressure chamber defining member for defining an orbiting backpressure chamber which pushes the orbiting scroll toward the fixed scroll is disposed in the casing so as to be positioned on a reverse surface of the orbiting scroll; a seal mechanism for sealing the orbiting backpressure chamber from outside is provided on an outer circumference side or an inner circumference side of the orbiting backpressure chamber; the seal mechanism comprises an annular groove provided on a slide surface of the backpressure chamber defining member, with which the backpressure chamber defining member slides on the orbiting scroll, and an annular seal member fittedly inserted in the groove and having a surface used as a slide surface; the slide surface of the seal member contacts a slide surface of the orbiting scroll on their flat surfaces; the orbiting backpressure chamber on a high pressure side and outside on a low pressure side are defined; a leak preventer for preventing a pressure of the high pressure side from leaking into the low pressure side is disposed between the seal member and the groove so as to be positioned on the low pressure side on an inner circumference side or an outer circumference side of the seal member; the leak preventer, a bottom portion side of the groove and the seal member define a backpressure chamber in communication with the orbiting backpressure chamber on the high pressure side; and when the seal member is in a used state, the slide surface of the seal member extends radially toward the low pressure side relative to a boundary of the low pressure side of the backpressure chamber.

The slide surface of the seal member may be configured such that a contact area of the slide surface of the seal member with the orbiting scroll increases due to abrasion of the slide surface of the seal member.

The slide surface of the seal member may include a portion which is gradually being spaced apart relative to the orbiting scroll from the slide surface of the seal member toward the low pressure side.

The seal member may include, on the high pressure side of the slide surface thereof, a high-pressure-side stepped portion facing the orbiting scroll in a spaced-apart relationship with the orbiting scroll.

A shallow bottom portion having a shallower depth than that of the bottom portion of the groove may be formed on the low pressure side of the groove; a cutout portion configured to match the shallow bottom portion may be formed on the seal member; and the leak preventer may be disposed between the cutout portion of the seal member and a low-pressure-side deep groove peripheral wall positioned between the bottom portion and the shallow bottom portion of the groove.

A low-pressure-side shallow groove peripheral wall positioned between the shallow bottom portion of the groove and an opening may be formed; and a first gap defined between the seal member and the low-pressure-side deep groove peripheral wall of the groove may be larger than a second gap defined between the seal member and the low-pressure-side shallow groove peripheral wall of the groove.

The fixed scroll and the orbiting scroll may be formed with use of a member in which an alumite treatment is performed on an aluminum material, and the seal member may be mainly made of polytetrafluoroethylene.

DETAILED DESCRIPTION OF THE PREFERRED EMBODIMENT

Figure 1:
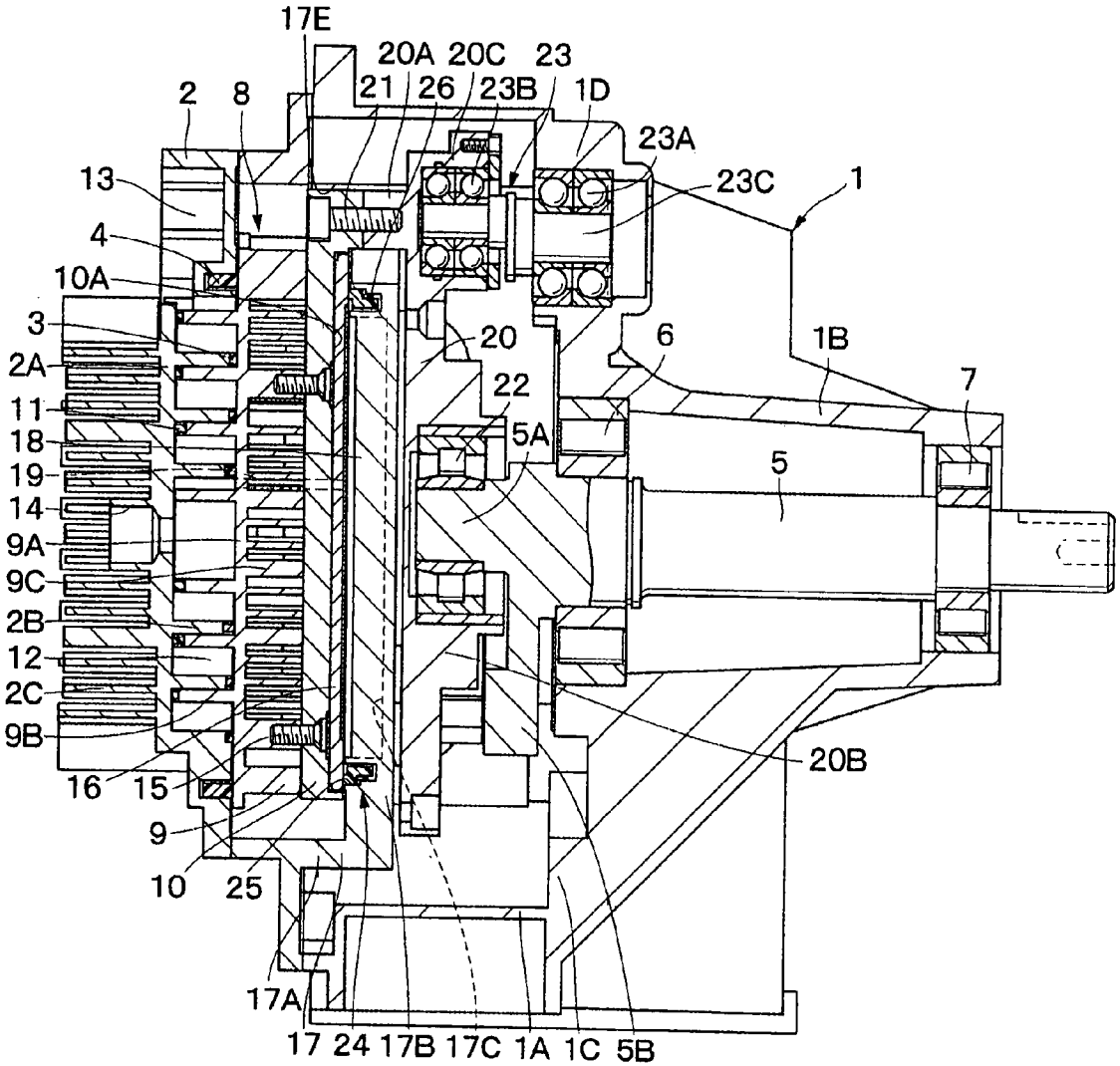
FIG. 1 is a sectional view of a booster air compressor according to a first embodiment of the present invention.
Figure 2:
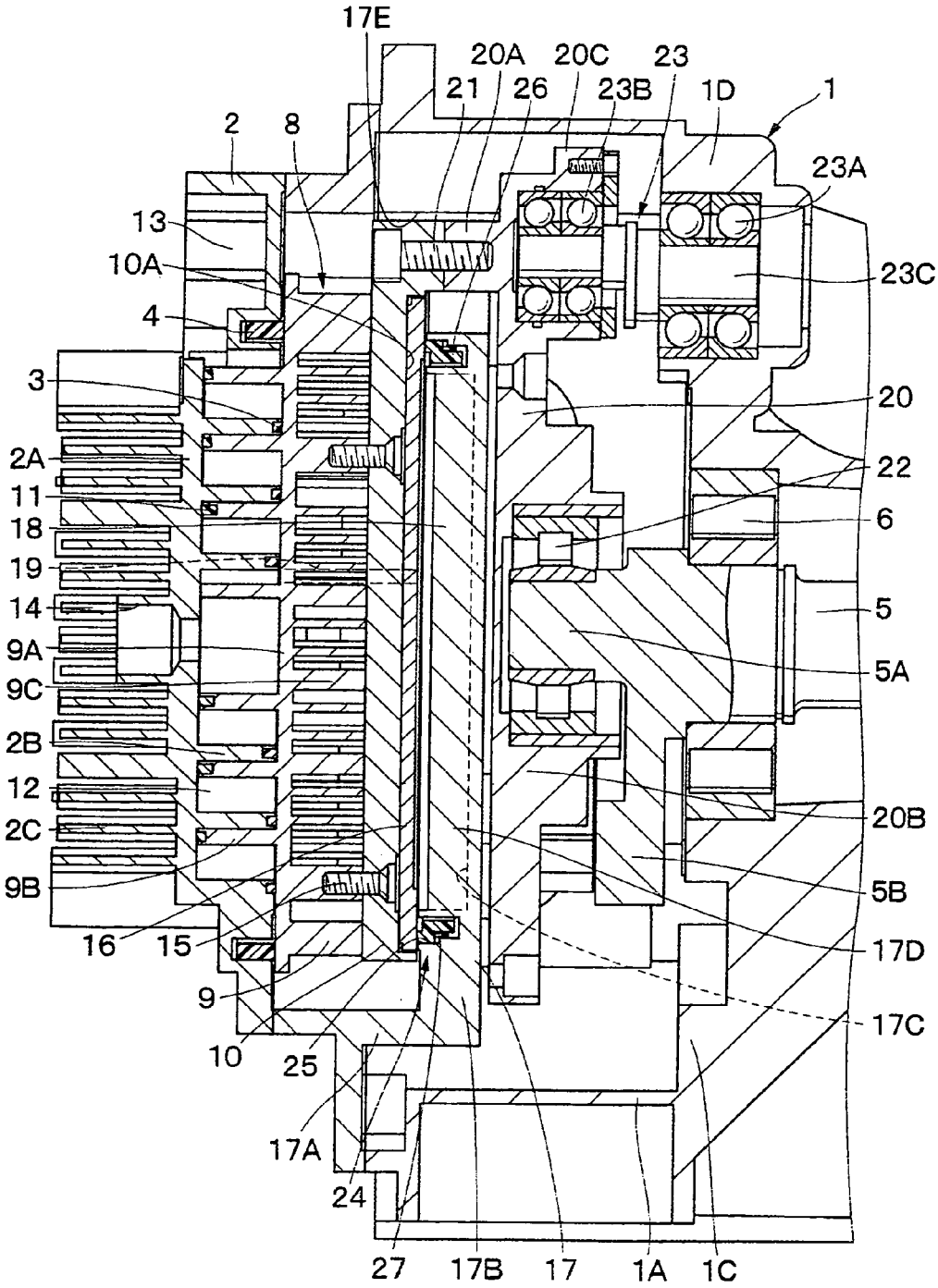
FIG. 2 is an expanded sectional view expanding and illustrating main parts of the booster air compressor shown in FIG. 1.
Figure 3:
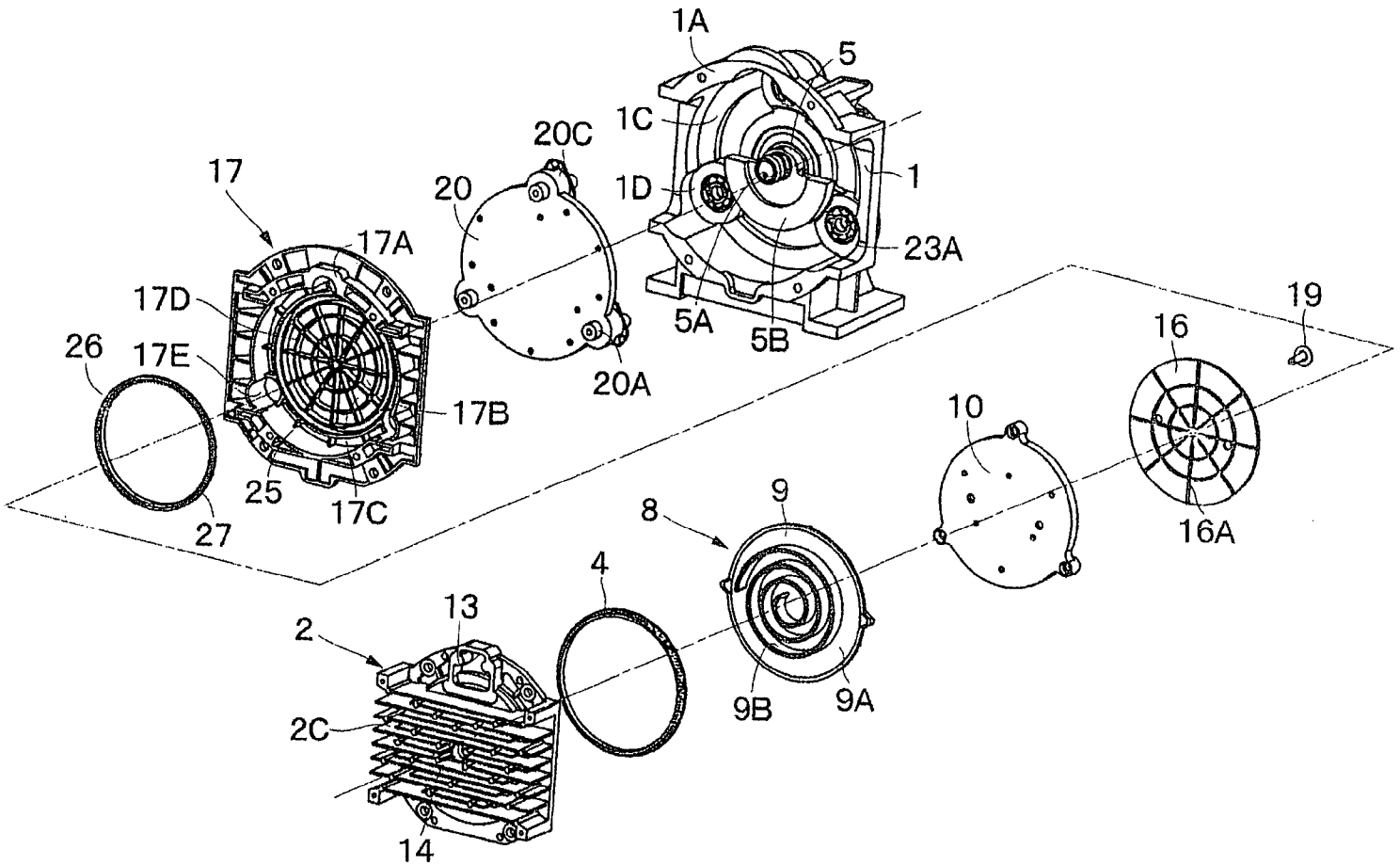
FIG. 3 is an exploded perspective view illustrating the booster air compressor shown in FIG. 1.
Figure 4:
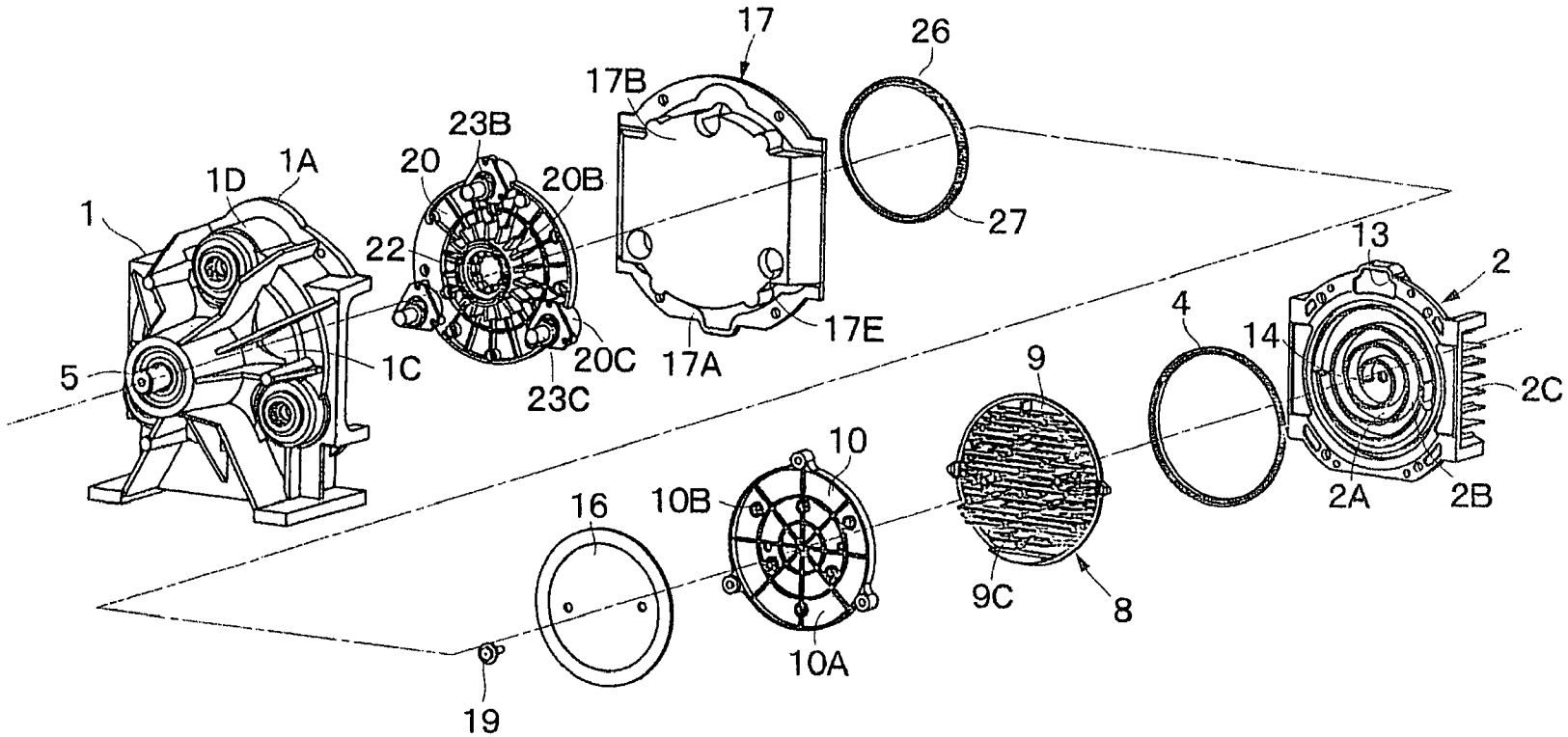
FIG. 4 is an exploded perspective view of the booster air compressor as viewed from a direction different from FIG. 3.

Hereinbelow, a scroll type fluid machine embodying the present invention will be described in detail with reference to the accompanying drawings, taking as an example thereof a booster air compressor which further compresses compressed air.

FIGS. 1 to 6 show a first embodiment of the present invention. In the drawings, reference numeral 1 denotes a cylindrical casing forming an outer frame of the booster air compressor. The casing 1 comprises a large-diameter cylinder portion 1A, a small-diameter bearing cylinder portion 1B which has a form of a cylinder having a smaller diameter than the large-diameter cylinder portion 1A and protrudes outwardly from one axial side of the large-diameter cylinder portion 1A, and an annular portion 1C formed between the large-diameter cylinder portion 1A and the bearing cylinder portion 1B. Further, cylindrical bearing-accommodating portions 1D, each of which accommodates a bearing 23A of an auxiliary crank mechanism 23 described later, is provided in the annular portion 1C. The number of bearing-accommodating portions 1D provided may be, for example, three. The bearing-accommodating portions 1D are evenly spaced-apart around a circumference of the annular portion 1C.

Reference numeral 2 denotes a fixed scroll disposed in the casing 1 through a holder 17 which will be described later. The fixed scroll 2 may be formed by, for example, performing an alumite treatment on a surface of an aluminum material. The fixed scroll 2 is attached to an attachment cylinder portion 17A of the holder 17 so as to close the large-diameter cylinder portion 1A of the casing 1 from the other axial side. In this way, the fixed scroll 2 is fixed to the other side (open side) of the large-diameter cylinder portion 1A with the holder 17 sandwiched therebetween. The fixed scroll 2 generally comprises a disk-like end plate 2A, and a spiral wrap portion 2B erected from a surface of the end plate 2A with a start end of the spiral positioned on a center side of the surface of the end plate 2A and a stop end of the spiral positioned on a periphery side of the surface of the end plate 2A.

A tip seal 3 is disposed on a tip surface of the wrap portion 2B to provide a seal between the wrap portion 2B and an end plate 9A of an orbiting scroll 8 which will be described later. An annular seal member 4 is disposed on the surface of the end plate 2A of the fixed scroll 2. The seal member 4 prevents compressed air from leaking from compression chambers 12 by providing a seal between the end plate 2A and the end plate 9A of the orbiting scroll 8.

A plurality of cooling fins 2C is formed on a reverse surface side of the end plate 2A of the fixed scroll 2 so as to extend in parallel. The cooling fins 2C cool the end plate 2A of the fixed scroll 2 and the like from the reverse surface side by circulating a cooling air flow between the cooling fins 2C.

Reference numeral 5 denotes a driving shaft which is a rotational shaft rotatably disposed within the bearing cylinder portion 1B of the casing 1 through bearings 6 and 7. The one axial side of the driving shaft 5 protrudes from the bearing cylinder portion 1B toward the outside of the casing 1, while the other axial side (front side) thereof forms a crank portion 5A extending in the large cylinder portion 1A of the casing 1. A pulley (not shown) is attached to one side of the driving shaft 5. The driving shaft 5 is coupled through the pulley to an electric motor (not shown) which serves as a driving source. Accordingly, the driving shaft 5 is driven by the electric motor to rotate.

The crank portion 5A is formed so that its axis is eccentric relative to the axis of the driving shaft 5 by a predetermined distance. The crank portion 5A is rotatably attached within a boss portion 20B of a coupling member 20 through an orbiting bearing 22 which will be described later. A balancing weight portion 5B is integrally formed with the driving shaft 5 to achieve rotational balance of the driving shaft 5.

Reference numeral 8 denotes an orbiting scroll rotatably disposed within the large-diameter cylinder portion 1A of the casing 1. The orbiting scroll 8 may be formed by, for example, performing an alumite treatment on a surface of an aluminum material. The orbiting scroll 8 is positioned so as to face the fixed scroll 2. The orbiting scroll 8 comprises an orbiting scroll body 9 facing the fixed scroll 2 in the axial direction of the casing 1, and a joint member 10 fixedly attached to a reverse surface side of the orbiting scroll body 9 to serve as a pressure receiver.

The orbiting scroll body 9 comprises the substantially cylindrical end plate 9A, and a spiral wrap portion 9B erected from the end plate 9A toward the fixed scroll 2 side. A tip seal 11 is disposed on a tip surface of the wrap portion 9B to provide a seal between the wrap portion 9B and the end plate 2A of the fixed scroll 2.

The orbiting scroll 8 is arranged so that the orbiting scroll 8 and the fixed scroll 2 overlap each other with an angular displacement of, for example, 180 degrees. By this arrangement, the plurality of compression chambers 12 (sealed chambers) are defined between the wrap portions 2B and 9B from the radially outer side to the radially inner side (center) of the scrolls. When the compressor operates, compressed air is drawn through an inlet 13 provided on the periphery side of the fixed scroll 2 into the compression chamber 12 on the radially outer side, and is successively compressed in each compression chamber 12. Then, the compressed air contained in the compression chamber 12 on the center side is discharged toward the outside through an outlet 14 provided on the center side of the fixed scroll 2.

A plurality of cooling fins 9C are formed on the end plate 9A of the orbiting scroll body 9 between the end plate 9A and the joint member 10. The cooling fins 9C horizontally extend in the same direction as the cooling fins 2C of the fixed scroll 2 extend, and the cooling fins 9C cool the end plate 9A of the orbiting scroll 8 and the like by means of a cool air flow.

The joint member 10 of the orbiting scroll 8 is fixed to the reverse surface side of the end plate 9A by a plurality of bolts 15. A recessed portion 10A is provided on a center side of a reverse surface of the joint member 10 as a circular recess formed over the substantially entire surface. For example, the recessed portion 10A may have a dimension such that it covers the entire area of the wrap portion 9B. A backpressure plate 16, which will be described later, is attached in the recessed portion 10A. By this arrangement, the joint member 10 receives a pressure within an orbiting backpressure chamber 18, which will be described later, through the backpressure plate 16. A net-like rib 10B is provided in the recessed portion 10A of the reverse surface of the joint member 10 so as to cover substantially the entire surface. The rib 10B increases a strength of the joint member 10.

Reference numeral 16 denotes a backpressure plate (member on one side) attached to the reverse surface of the joint member 10. The backpressure plate 16 may be formed by, for example, performing an alumite treatment on a surface of an aluminum material. The backpressure plate 16 has a dimension substantially equal to the recessed portion 10A of the joint member 10, and is formed as a disk. The backpressure plate 16 is attached in the recessed portion 10A of the joint member 10 in a spaced-apart relationship with the end plate 9A of the orbiting scroll 8. The backpressure plate 16 includes a front surface in contact with a bottom surface of the recessed portion 10A, and a reverse surface 16A defining the orbiting backpressure chamber 18 which will be described later. By this arrangement, the backpressure plate 16 receives a pressure within the orbiting backpressure chamber 18 and pushes the entire orbiting scroll 8 toward the fixed scroll 2 through the joint member 10. Further, a net-like rib 16B is provided to the front (front surface) of the backpressure plate 16 so as to cover substantially the entire surface for increasing a strength of the backpressure plate 16.

Reference numeral 17 denotes a holder (member on the other side) which is a member fixedly disposed to the casing 1 side behind the orbiting scroll 8 to define the backpressure chamber. The holder 17 may be formed by, for example, performing an alumite treatment on a surface of an aluminum material. The holder 17 is integrally formed with the casing 1. The holder 17 comprises the attachment cylinder portion 17A attached to an open end of the large-diameter cylinder portion 1A of the casing 1, and a substantially disk-like bottom plate portion 17B which is positioned on the other end side in an axial direction of the attachment cylinder portion 17A, and forms a bottom surface. The attachment cylinder portion 17A is sandwiched on the outer circumference side thereof between the fixed scroll 2 and the large-diameter cylinder portion 1A of the casing 1, and accommodates therein the joint member 10 of the orbiting scroll 8 and the backpressure plate 16.

A seal mechanism 24, which will be described later, is disposed on a periphery side of the bottom plate portion 17B. Further, a compressed-air-containing portion 17C is provided on a center side of the bottom plate portion 17B so as to be positioned on a radially inner side of the seal mechanism 24. The compressed-air-containing portion 17C is in the form of a bottomed cylinder recessed toward a reverse surface side of the portion 17B. The compressed-air-containing portion 17C is disposed so as to face the backpressure plate 16, has an area smaller the backpressure plate 16, and is open to the backpressure plate 16 side. By these arrangements and dimensions, the holder 17 defines the disk-like orbiting backpressure chamber 18 positioned in the compressed-air-containing portion 17C between the holder 17 and the backpressure plate 16. The orbiting backpressure chamber 18 is airtightly sealed by the seal mechanism 24 around the circumference thereof.

A net-like rib 17D is provided on the bottom plate portion 17B within the compressed-air-containing portion 17C for increasing a strength of the bottom plate portion 17B.

Three spill ports 17E are provided outside of the seal mechanism 24 on the bottom plate portion 17B so as to axially extend through the portion 17B. The spill ports 17E may be, for example, disposed in an evenly spaced-apart relationship around the circumference. Coupling protrusion portions 20A of the coupling member 20, which will be described later, are inserted through the spill ports 17E. Due to the spill ports 17E, when the orbiting scroll 8 performs an orbiting motion together with the coupling member 20, the coupling protrusion portions 20A coupling them are prevented from interfering with the holder 17. Reference numeral 19 denotes a backpressure introduction tube 19 attached between the orbiting scroll body 9 of the orbiting scroll 8 and the joint member 10 as an coupling member therebetween. The number of the attached backpressure introduction tube 19 may be, for example, two. The backpressure introduction tube 19 penetrates through the backpressure plate 16 and the joint member 10, and is threaded to the reverse surface side of the orbiting scroll 8. The back pressure introduction tube 19 includes therein a backpressure introduction hole (not shown) axially extending therethrough. The backpressure introduction tube 19 has one end in communication with the orbiting backpressure chamber 18, and the other end in communication with the compression chamber 12 by penetration of the end plate 9A of the orbiting scroll 8. By this arrangement, the backpressure introduction tube 19 guides compressed air within the compression chamber 12 into the orbiting backpressure chamber 18. The backpressure introduction tube 19 also serves as a coupling member securely coupling the orbiting scroll body 9 and the joint member 10.

The reference numeral 20 denotes a coupling member sandwiching the holder 17 and disposed on the one axial side. The coupling member 20 has a substantially disk-like form, and includes the three coupling protrusion portions 20A disposed on the front side thereof. The coupling protrusion portions 20A protrude toward the holder 17. The coupling protrusion portions 20A are disposed in a evenly spaced-apart relationship around the circumference of the coupling member 20. The coupling protrusion portions 20A are integrated with the orbiting scroll 8 by being respectively inserted through the spill ports 17E of the holder 17 to be coupled to the joint member 10 of the orbiting scroll 8 by coupling bolts 21.

The cylindrical boss portion 20B is integrally formed in a center side on a reverse surface of the coupling member 20. The crank portion 5A of the driving shaft 5, which will be described later, is rotatably attached in the boss portion 20B through the orbiting bearing 22. By this arrangement, the coupling member 20 couples the orbiting scroll 8 and the driving shaft 5 with the holder 17 sandwiched therebetween, so that the coupling member 20 performs an orbiting motion together with the orbiting scroll 8 when the driving shaft 5 rotates.

Cylindrical bearing-accommodating portions 20C, each of which accommodates a bearing 23B of the auxiliary crank mechanism 23 described later, are provided on a periphery side of the reverse surface of the coupling member 20. The number of the provided bearing-accommodating portions 20C may be, for example, three. The bearing-accommodating portion 20C is positioned to face the bearing-accommodating portion 1D of the casing 1, and is also positioned on the one axial side of the coupling protrusion portion 20A.

Reference numeral 23 denotes an auxiliary crank mechanism disposed between the coupling member 20 and the casing 1 as a mechanism for preventing a self-rotation. The auxiliary crank mechanism 23 comprises the bearing 23A accommodated in the bearing-accommodating portion 1D of the casing 1, the bearing 23B accommodated in the bearing-accommodating portion 20C of the coupling member 20, and a crank member 23C rotatably attached to the bearings 23A and 23B. The auxiliary crank mechanism 23 prevents the orbiting scroll 8 from rotating on its own axis in the casing 1 when performing an orbiting motion.

Reference numeral 24 denotes a seal mechanism provided between the holder 17 and the backpressure plate 16. The seal mechanism 24 comprises a seal attachment groove 25 which will be described later, a seal member 26, a Y-shaped packing 27, and the like.

Reference numeral 25 denotes an annular seal attachment groove provided along the periphery of the bottom plate portion 17B. The seal attachment groove 25 is provided on a slide surface of the bottom plate portion 17B, with which the portion 17B slides on the backpressure plate 16 (orbiting scroll 8), so as to be open to the backpressure plate 16. A bottom portion 25A having a large depth is formed on an inner circumference side of the seal attachment groove 25, i.e., a high pressure side (an orbiting backpressure chamber 18 side). On the other hand, the seal attachment groove 25 is stepped on an outer circumference side thereof, i.e., a low pressure side (an outer side), defining a shallow bottom portion 25B having a little depth. In other words, the seal attachment groove 25 includes the bottom portion 25A having a large depth and the shallow bottom portion 25B having a shallow depth which are formed on the basis of a radially intermediate diameter R0 between a radially inner diameter and a radially outer diameter of an opening side, i.e., the bottom portion 25A formed in a part having a diameter smaller than the radially intermediate diameter R0 and the shallow bottom portion 25B formed in a part having a diameter larger than the radially intermediate diameter R0. The seal attachment groove 25 further includes, on the low pressure side, a deep groove peripheral wall 25C positioned between the bottom portion 25A and the shallow bottom portion 25B, and a shallow groove peripheral wall 25D positioned between the shallow bottom portion 25B and the opening.

Reference numeral 26 denotes an annular seal member fittedly inserted in the seal attachment groove 25. The seam member 26 may be mainly made of a tetrafluoride resin material such as polytetrafluoroethylene (PTFE) which has excellent lubricating property and anti-abrasion property. The seal member 26 comprises an annular continuous body without any discontinuity around the circumference. The seal member 26 is configured to be prevented from radially expanding and to achieve a balance of loads acting in the radial direction perpendicular to the groove periphery walls 25C and 25D of the seal attachment groove 25, even when the seal member 26 receives a pressure from the orbiting backpressure chamber 18 on an inner circumference side thereof, and an atmospheric pressure on an outer circumference thereof.

In the seal member 26, a surface facing the axial direction (front surface) serves as a slide surface 26A in sliding contact with the backpressure plate 16. The slide surface 26A of the seal member 26 contacts a reverse surface 16A serving as a slide surface of the backpressure plate 16, on their surfaces. On the other hand, a reverse surface 26B of the seal member 26 is inserted in a deep part of the seal attachment groove 25 to be disposed to face the bottom portion 25A, thereby defining a backpressure chamber 28 which will be described later.

Further, in the seal member 26, a high pressure side (inner circumference side) of the slide surface 26A is rectangularly cut out to define a high-pressure-side stepped portion 26C. The high-pressure-side stepped portion 26C is positioned so as to face the backpressure plate 16 in a spaced-apart relationship with the backpressure plate 16. In other words, the slide surface 26A of the seal member 26 has a front-surface radially inner diameter R1 and a front-surface radially outer diameter R2, and the high-pressure-side stepped portion 26C is positioned radially inside the front-surface radially inner diameter R1 of the seal member 26. Compressed air in the orbiting backpressure chamber 18 is supplied into a space between the high-pressure-side stepped portion 26C of the seal member 26 and the backpressure plate 16.

On the other hand, a rectangular cutout portion 26D matching the shallow bottom portion 25B of the seal attachment groove 25 is formed on a low pressure side (outer circumference side) of the reverse surface 26B of the seal member 26. Therefore, the seal member 26 has a cross section in the form of a crank, and due to the cutout portion 26D, the reverse surface 26B can be inserted to the bottom portion 25A without interference with the shallow bottom portion 25B.

A low-pressure-side extension portion 26E extending to the outer circumference side relative to the deep groove peripheral wall 25C is formed on the low pressure side of the seal member 26. The low-pressure-side extension portion 26E is positioned radially inside the shallow groove peripheral wall 25D. Therefore, the seal member 26 is fittedly inserted into the seal attachment groove 25 without interference with the shallow groove peripheral wall 25D.

Further, a first gap S1 is defined between the seal member 26 and the deep groove peripheral wall 25C, and a second gap S2 is defined between the seal member 26 and the shallow groove peripheral wall 25D. The first gap S1 is larger than the second gap S2.

Reference numeral 27 denotes a Y-shaped packing which is a leak prevention means disposed between the seal attachment groove 25 and the seal member 26. The Y-shaped packing 27 is disposed in the first gap S1 between the seal member 26 and the deep groove peripheral wall 25C. The Y-shaped packing 27 includes two lips portion 27A split from the one axial side to the other axial side so as to be V-shaped. The two lips portion 27A is open while facing the bottom portion 25A of the seal attachment groove 25, and its lips respectively contact the seal member 26 and the deep groove peripheral wall 25C. The Y-shaped packing 27, together with the bottom portion 25A side of the seal attachment groove 25 and the seal member 26, defines the backpressure chamber 28 in communication with the orbiting backpressure chamber 18 on the high pressure side. Therefore, the lips portion 27A of the Y-shaped packing 27 receives a pressure from the orbiting backpressure chamber 18, and the two lips portion 27A is made open by this pressure. In this way, the Y-shaped packing 27 prevents a pressure of the orbiting backpressure chamber 18 on the high pressure side from leaking into the low pressure side.

Since the Y-shaped packing 27 is disposed between the seal member 26 and the deep groove peripheral wall 25C, the backpressure chamber 28 is kept inside the bottom portion 25A of the seal attachment groove 25, and does not extend to the outer circumference side beyond the shallow bottom portion 25B. Therefore, the slide surface 26A of the seal member 26 always extends toward the low pressure side in the radially outer direction relative to the deep groove peripheral wall 25C which serves as a boundary of the low pressure side of the backpressure chamber 28.

Here, an effective area of the backpressure side of the seal member 26 is defined as a difference between the area of the slide surface 26A side (backpressure plate 16 side), on which a pressure from the high pressure side of the seal member 26 directly acts, and the area of the reverse surface 26B side (holder 17 side). Therefore, the effective area of the backpressure side of the seal member 26 is an area of an annular portion between the front-surface radially inner diameter R1 and the radially intermediate diameter R0.

The booster air compressor in the present embodiment is configured as described above. Next, an operation of this compressor will be described.

When the driving shaft 5 is driven to rotate by the driving source such as an electric motor, the rotation of the driving shaft 5 is transmitted to the orbiting scroll 8 through the orbiting bearing 22. Then, the orbiting scroll 8 starts to perform an orbiting motion about the driving shaft 5 while being prevented from rotating on its own axis by the auxiliary crank mechanism 23.

The compression chambers 12 defined between the wrap portion 2B of the fixed scroll 2 and the wrap portion 9B of the orbiting scroll 8 become successively smaller from the radially outer side to the radially inner side. The compressor, while drawing compressed air supplied from, for example, a factory pipe through the inlet 13, successively compresses the drawn compressed air in the compression chambers 12, and then discharges the compressed high pressure air through the outlet 14 to, for example, an external tank (not shown).

The compressed air which has been further compressed in the compression chambers 12 is partially introduced through the backpressure introduction tube 19 into the orbiting backpressure chamber 18 defined on the reverse surface side of the orbiting scroll 8. By this arrangement, even when an excessive thrust load, which pushes the orbiting scroll 8 away from the fixed scroll 2, is generated due to the pressure of the compressed air, it is possible that the orbiting scroll 8 may be pushed back toward the fixed scroll 2 side due to the pressure in the orbiting backpressure 18, thereby decreasing the influence of the thrust load.

Figure 5:
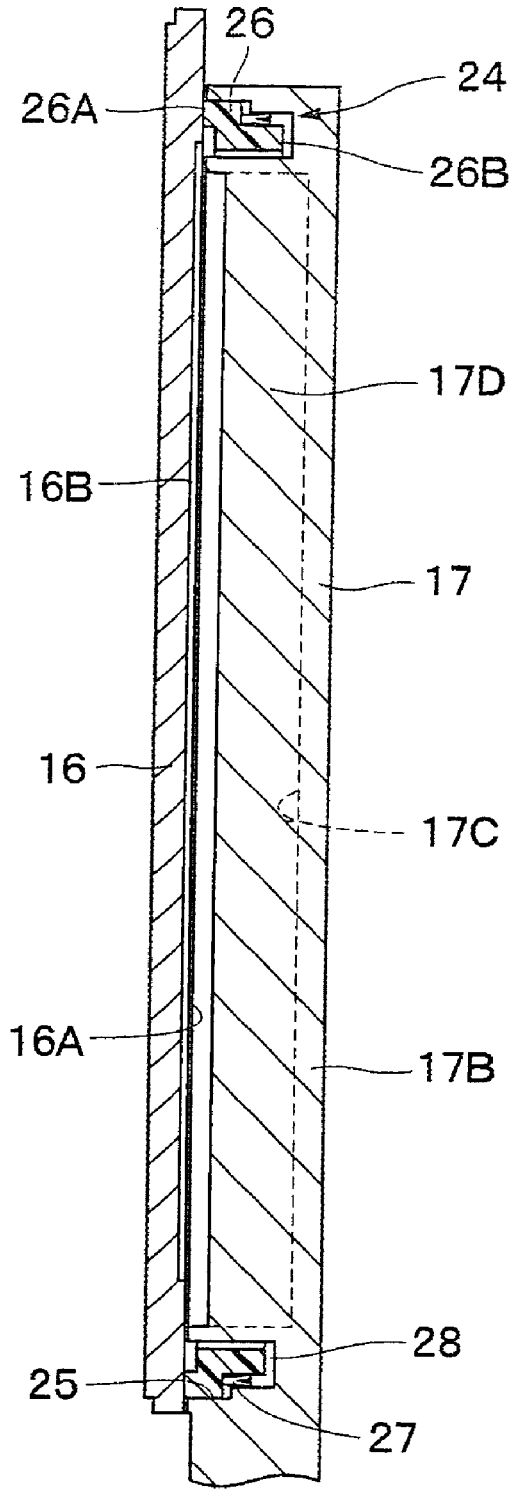
FIG. 5 is an expanded sectional view expanding and illustrating the backpressure plate, the holder, the seal mechanism and the like shown in FIG. 2.
Figure 6:
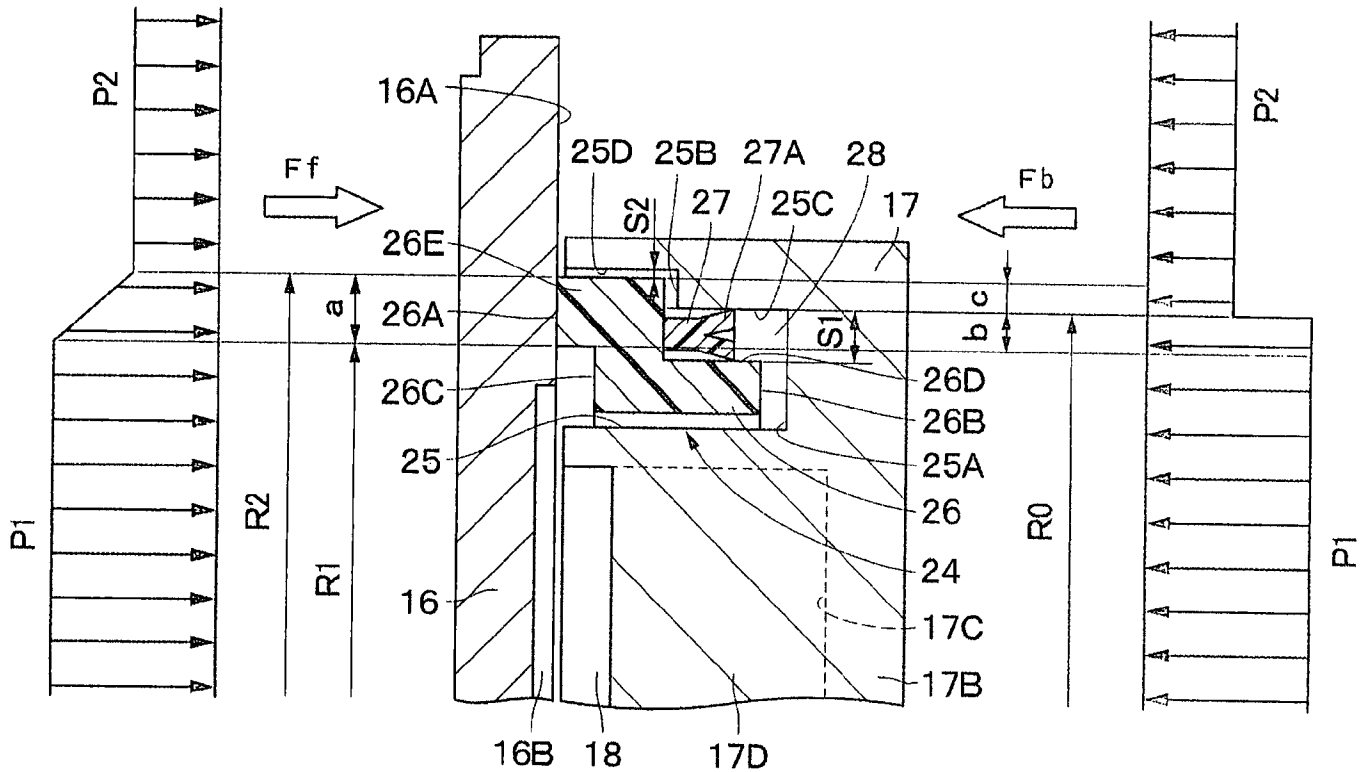
FIG. 6 is an expanded sectional view of main parts, which expands and illustrates the seal mechanism shown in FIG. 5.

Next, an operation of the seal mechanism 24 will be described in detail with reference to FIGS. 5 to 6.

First, analysis will be made with regards to a pressure on the slide surface 26A side, which acts on the slide surface 26A toward the reverse surface 26B of the seam member 26. An inner pressure P1, which is as high as the pressure in the orbiting backpressure chamber 18, acts on the radially inner side of the seal member 26 relative to the front-surface radially inner diameter R1. On the other hand, an outer pressure P2, which is as low as the pressure in the casing 1, acts on the radially outer side of the seal member 26 relative to the front-surface radially outer diameter R2. The slide surface 26A of the seal member 26 is positioned in the portion having a width a between the front-surface radially inner diameter R1 and the front-surface radially outer diameter R2, and the surface 26A contacts the backpressure plate 16. Therefore, a pressure acting on the slide surface 26A (the portion having the width a) of the seal member 26 has values that vary consecutively from the pressure P1 to the pressure P2.

Next, analysis will be made with regards to a pressure on the reverse surface 26B side, which acts on the reverse surface 26B toward the slide surface 26A of the seam member 26. The Y-shaped packing 27 is disposed between the seal member 26 and the deep groove peripheral wall 25C of the seal attachment groove 25. Therefore, the high inner pressure P1 acts on the radially inner side of the seal member 26 relative to the radially intermediate diameter R0 of the seal attachment groove 25. On the other hand, the low outer pressure P2 acts on the radially outer side of the seal member 26 relative to the radially intermediate diameter R0 of the seal attachment groove 25.

On the high-pressure-side stepped portion 26C of the seal member 26, both of the pressure P1 from the slide surface 26A side and the pressure P1 from the reverse surface 26B side act, and therefore the pressures are balanced out. As a result, in the seal member 26, only the portion positioned radially outside the high-pressure-side stepped portion 26C is subject to a load generated due to the pressure difference.

A load Ff obtained by integrating the distributed pressures over the portion having the width a acts on the slide surface 26A of the seal member 26. On the other hand, a load Fb acts on the reverse surface 26B side of the seal member 26. The load Fb is a resultant force obtained by adding a load obtained by integrating the pressure P1 over the portion (the portion of the effective area) having a width b between the front-surface radially inner diameter R1 and the radially intermediate diameter R0, and a load obtained by integrating the pressure P2 over the portion having a width c between the front-surface radially outer diameter R2 and the radially intermediate diameter R0

If the front-surface radially outer diameter R2 is equal to or less than the radially intermediate diameter R0 (R2=R0 or R2<R0), a difference between the load Fb of the reverse surface 26B and the load Ff of the slide surface 26A cannot be smaller than a difference between the reverse surface 26B side load obtained by integrating the pressure P1 over the portion having the width b and the slide surface 26A side load obtained by integrating the pressures distributed in the range of the pressure p1 to the pressure P2. Assuming that the change in the pressure over the portion having the width a is substantially liner, a load obtained by integrating the pressure (P1-P2)/2 acts on the seal member 26 over the portion having the width b, and therefore the seal member 26 is pressed from the reverse surface 26B toward the slide surface 26A.

In the present embodiment, the front-surface radially outer diameter R2 is set to be larger than the radially intermediate diameter R0 (R2>R0), and the slide surface 26A extends to the low pressure side (radially outer side) beyond the deep groove peripheral wall 25C. With the portion having the width a extending outwardly, the area receiving a pressure higher than the pressure P2 increases on the slide surface 26A, while the area receiving the pressure P2 (the portion with the width c) increases on the reverse surface 26B side. Therefore, the difference between the load Fb on the reverse surface 26B and the load Ff on the slide surface 26A is reduced, so that it becomes possible to reduce a pressing force of the seal member 26 according to expansion of the portion with the width C. As a result, it becomes possible to slow down a rate of abrasion of the seal member 26.

Further, the low pressure P2 is introduced over an extensive area on an outer circumferential surface of the seal member 26, and due to the difference between the pressures P1 and P2, a load pushing the seal member 26 toward the radially outer side acts on the seal member 26. However, the seal member 26 is formed into a continuous body without any discontinuity and therefore is configured to be unexpanded without being affected by the pressure difference. Furthermore, because the loads acting radially on the seal member 26 are balanced on the seal member 26, the seal member is not pressed to the deep groove peripheral wall 25C and the shallow groove peripheral wall 25D of the seal attachment groove 25. As a result, an operation of the seal member 26 is not restrained and no abrasion occurs, and therefore the outer circumferential surface of the seal member 26 does not suffer from advancing abrasion.

In the present embodiment, the area where the seal member 26 contacts the backpressure plate (the area of the slide surface 26A) is set so as to be larger than the effective area of the backpressure side of the seal member 26 when the seal member 26 is in a used state. While the pressure P1 on the high pressure side acts on the effective area of the backpressure side of the seal member 26, consecutive pressures distributed in the range of the pressure P1 on the high pressure side to the pressure P2 on the low pressure side acts on the slide surface 26A of the seal member 26. Therefore, it is possible to reduce increasingly the difference between the load acting on the slide surface 26A side and the load acting on the effective area of the backpressure side of the seal member 26, as the area of the slide surface 26A of the seal member 26 becomes larger than the effective area of the backpressure chamber 28. In this way, it is possible to reduce the pressing force of the seal member 26 even if a sealed pressure is high. As a result, it becomes possible to decrease a rate of abrasion of the seal member 26, and it is therefore possible to extend a lifetime of the seal member 26 and to improve a reliability and durability thereof.

Further, when the seal member 26 is in a used state, the slide surface 26A of the seal member 26 extends radially outwardly toward the low pressure side relative to the deep groove peripheral wall 25C which is a boundary of the low pressure side of the backpressure chamber 28. While the pressure P2 of the low pressure side acts on the radially outer side of the reverse surface 26B, relative to the radially intermediate diameter R0, of the low-pressure-side extension portion 26E of the seal member 26 which extends to the low pressure side beyond the deep groove peripheral wall 25C, the distributed pressures between the pressure P1 of the high pressure side and the pressure P2 of the low pressure side act on the slide surface 26A. Therefore, in the low-pressure-side extension portion 26E of the seal member 26, the slide surface 26A side receives a higher pressure than the reverse surface 26B side.

As a result, the low-pressure-side extension portion 26E of the seal member 26 enables the contact area between the slide surface 26A of the seal member 26 and the backpressure plate 16 to be larger than the effective area of the backpressure side of the seal member 26. Therefore, it becomes possible to reduce a difference between the load acting on the slide surface 26A side of the seal member 26 and the load acting on the reverse surface 26B side of the seal member 26, whereby the pressing force of the seal member 26 can be reduced.

Further, since the seal member 26 is formed into a continuous body without any discontinuity around the circumference, even though a pressure difference exists between the inner circumferential surface and outer circumferential surface of the seal member 26, the seal member 26 is not affected by the pressure difference, thereby being prevented from expanding. Further, since radially acting loads are balanced on the seal member 26 alone, the seal member 26 is not radially displaced so that the seal member 26 is not pressed to the deep groove peripheral wall 25C and the shallow groove peripheral wall 25D of the seal attachment groove 25. Therefore, a movement of the seal member 26 is not restrained by friction between the seal member 26 and the peripheral walls 25C, 25D of the seal attachment groove 25, and in addition to that, reliability and durability of the seal member 26 can be improved as the abrasion does not advance.

Further, since the seal member 26 includes, on the high pressure side of the slide surface 26A, the high-pressure-side stepped portion 26C facing the backpressure plate 16 in a spaced-apart relationship to the backpressure plate 16, the pressure P1 of the high pressure side can act on between the high-pressure-side stepped portion 26C and the backpressure plate 16. Therefore, it is possible to offset the force acting on the reverse surface 26B of the seal member 26 with the force acting on the high-pressure-side stepped portion 26C, so that the effective area of the backpressure side of the seal member 26, and therefore the pressing load of the seal member 26 can be reduced.

Further, the Y-shaped packing 27 is disposed in the first gap S1 between the deep groove peripheral wall 25C of the seal attachment groove 25 and the cutout portion 26D of the seal member 26. Due to provision of the Y-shaped packing, it is possible to prevent the pressure P1 of the high pressure side, which acts on the reverse surface 26B of the seal member 26, from leaking into the low pressure side.

Further, since the first gap S1 is larger than the second gap S2, even if the seal member 26 is radially displaced, the second gap S2 disappears before the first gap S1 does. Therefore, the presence of the first gap S1 is always ensured, so that the Y-shaped packing disposed in the first gap S1 is not compressed to be flattened.

Furthermore, in the present embodiment, each of the backpressure plate 16 and the holder 17 may be formed with use of a material in which an alumite treatment is performed on an aluminum material, and the seal member 26 may be mainly made of polytetrafluoroethylene (PTFE). If the seal member 26 is mainly made of a polytetrafluoroethylene material having excellent lubricating property and anti-abrasion property, it is possible to further enhance durability and reliability of the seal member 26.

Figure 7:
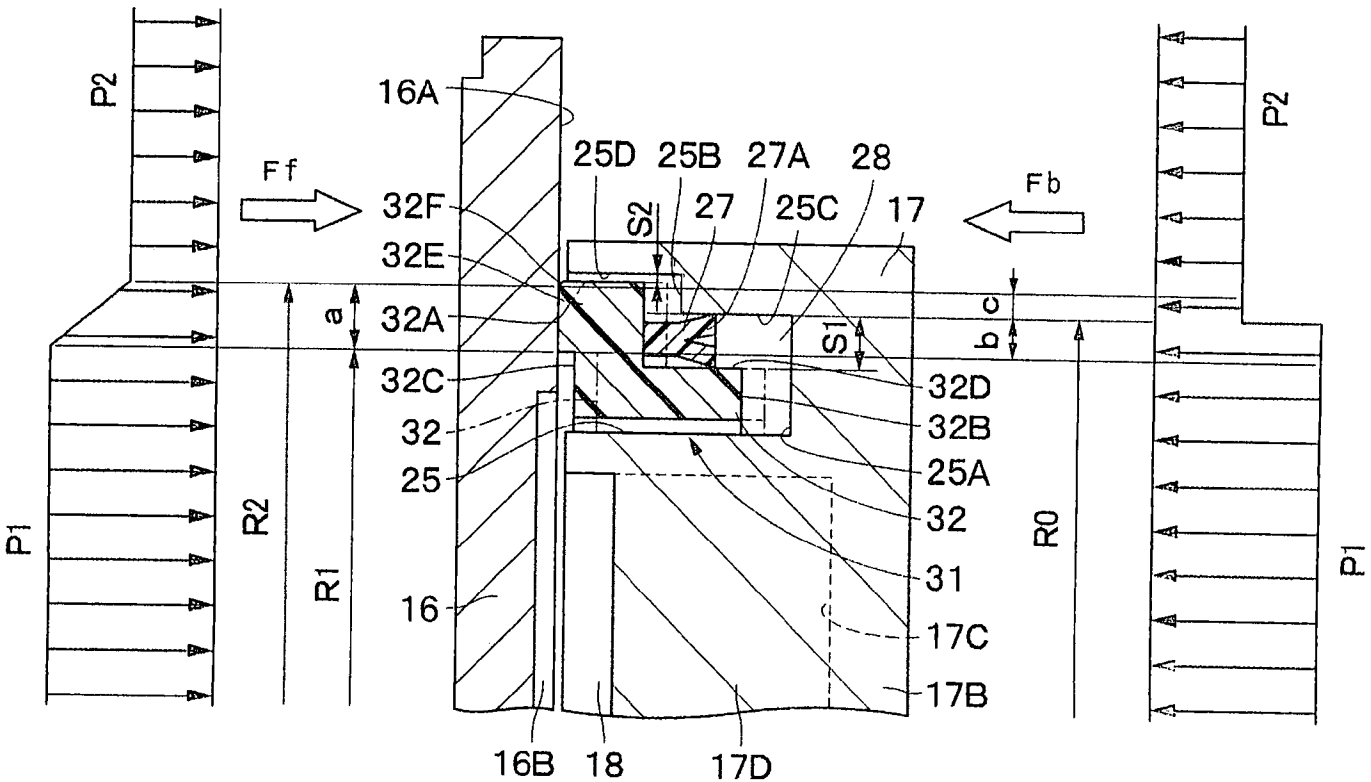
FIG. 7 is an expanded sectional view of main parts, which expands and illustrates a seal mechanism according to a second embodiment.
Figure 8:
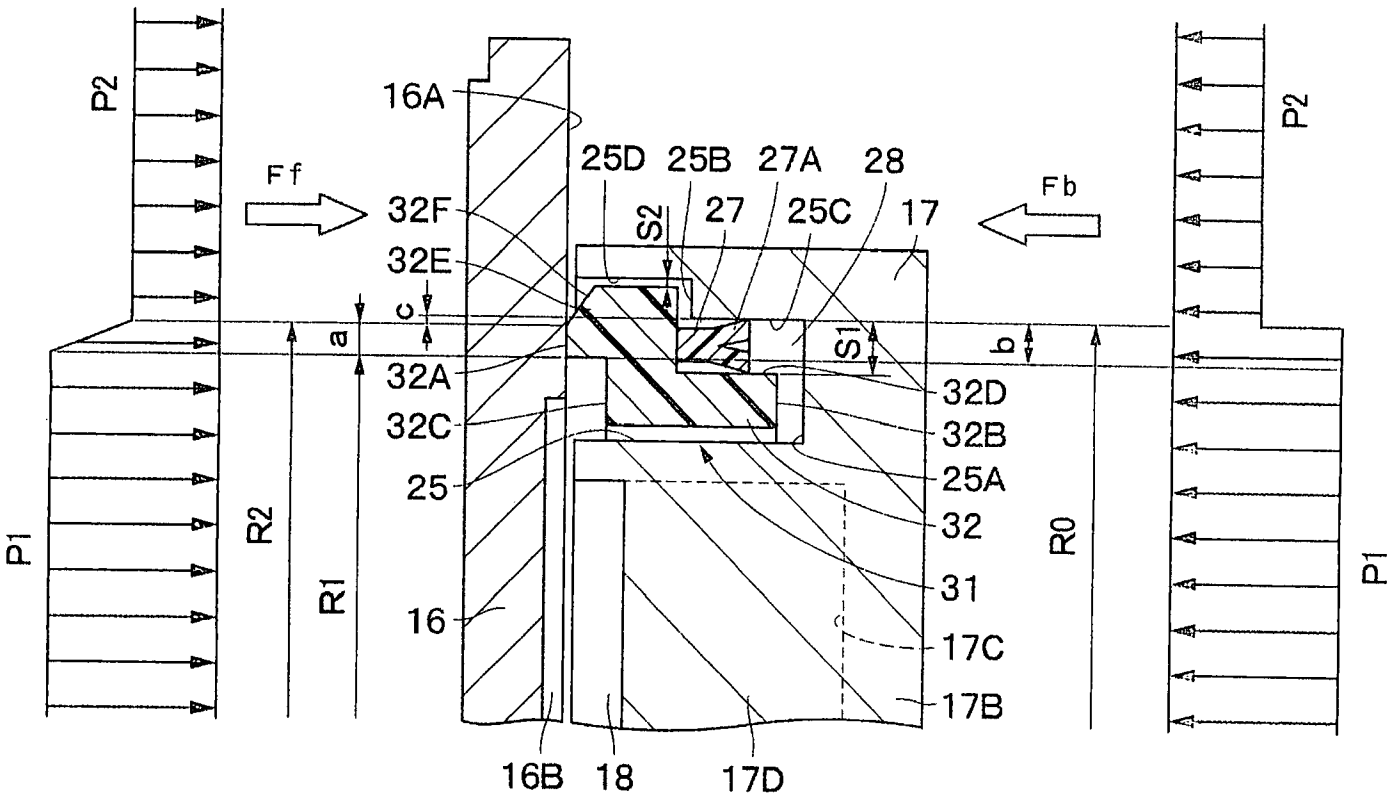
FIG. 8 is an expanded sectional view of main parts, which illustrates an initial state in which the seal member shown in FIG. 7 has just been attached.
Figure 9:
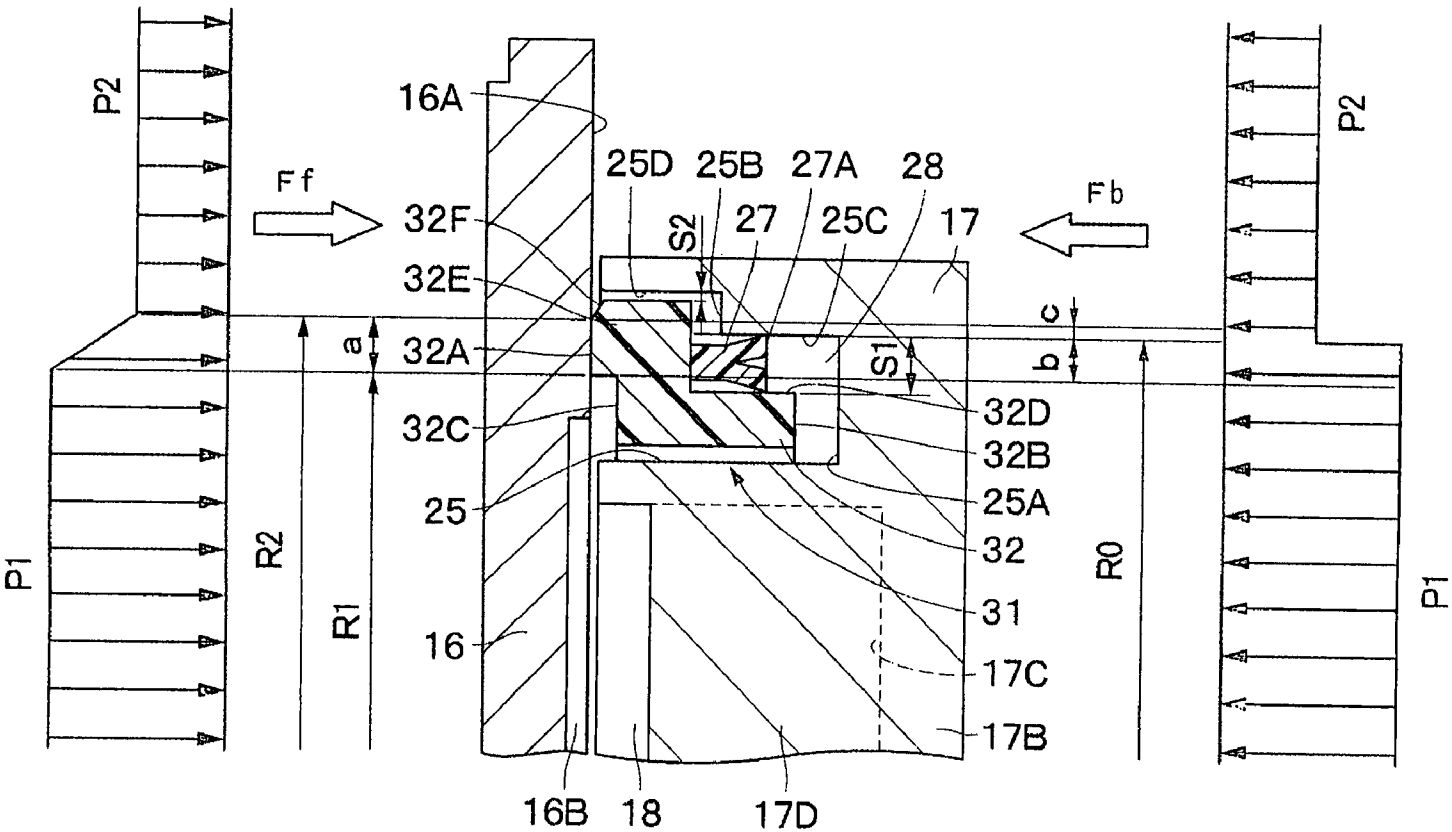
FIG. 9 is an expanded sectional view of main parts, which illustrates a state in which the seal member shown in FIG. 8 has abraded away.

FIGS. 7 to 9 show a second embodiment of the present invention. This embodiment is characterized in that a seal member is configured to increase a contact area of a slide surface of the seal member with a backpressure plate as an abrasion of the slide surface advances. In the second embodiment, elements corresponding to the above-described elements of the first embodiment will be assigned the same reference numerals as those used in the first embodiment, and the descriptions thereof will not be made in further detail.

Reference numeral 31 denotes a seal mechanism in the second embodiment, which is disposed between a holder 17 and a backpressure plate 16. The seal mechanism 31 comprises a seal attachment groove 25, a seal member 32, a Y-shaped packing 27 and the like, similarly to the seal mechanism 24 in the first embodiment.

Reference numeral 32 denotes an annular seal member fittedly inserted in the seal attachment groove 25. Substantially similarly to the seal member 26 in the first embodiment, the seal member 32 may be mainly made of a tetrafluoride resin material such as polytetrafluoroethylene (PTFE) which has excellent lubricating property and anti-abrasion property. The seal member 32 comprises an annular continuous body without any discontinuity around the circumference, and is configured such that radially acting loads thereon are balanced.

In the seal member 32, a surface facing the axial direction (front surface) serves as a slide surface 32A in sliding contact with the backpressure plate 16. The slide surface 32A of the seal member 32 contacts a reverse surface 16A serving as a slide surface of the backpressure plate 16, on their surfaces. On the other hand, a reverse surface 32B of the seal member 32 is inserted in a deep part of the seal attachment groove 25 to be disposed to face a bottom portion 25A, thereby defining a backpressure chamber 28.

Further, in the seal member 32, a high pressure side (inner circumference side) of the slide surface 32A is rectangularly cut out to define a high-pressure-side stepped portion 32C. The high-pressure-side stepped portion 32C is positioned so as to face the backpressure plate 16 in a spaced-apart relationship with the backpressure plate 16. On the other hand, a rectangular cutout portion 32D matching a shallow bottom portion 25B of the seal attachment groove 25 is formed on a low pressure side (outer circumference side) of the reverse surface 32B of the seal member 32.

A low-pressure-side extension portion 26E extending to an outer circumference side beyond a deep groove peripheral wall 25C is formed on a low pressure side of the seal member 32. The low-pressure-side extension portion 26E is positioned radially inside a shallow groove peripheral wall 25D. Further, a first gap S1 is defined between the seal member 32 and the deep groove peripheral wall 25C, and a second gap S2 is defined between the seal member 32 and the shallow groove peripheral wall 25D. The first gap S1 is larger than the second gap S2. A Y-shaped packing 27 is disposed in the first gap S1.

A chamfered inclined portion 32F is formed on the outer circumference side of the seal member 32 such that the front surface of the seal member 32 is gradually being spaced apart from the backpressure plate 16 as tapering from the slide surface 32A toward the low pressure side. This inclined portion 32F enables a contact area of the slide surface 32A with the backpressure portion 16 to increase due to an abrasion of the slide surface 32A. In other words, the slide surface 32A of the seal member 32 has a front-surface radially inner diameter R1 and a front-surface radially outer diameter R2, and is configured such that the front-surface radially outer diameter R2 increases as the slide surface 32A is abrading away.

Next, an operation of the seal mechanism 31 will be described in detail with reference to FIGS. 7 to 9. FIG. 8 shows an initial state of the seal member 32 which has been just attached. FIGS. 7 and 9 each show a state of the used seal member 32 which has slid relative to the backpressure plate 16, and has been adapted to the surroundings.

FIG. 8 shows an initial state in which the seal member 32 before abrading away has been just attached in the seal attachment groove 25. In this initial state, the front-surface radially outer diameter R2 of the slide surface 32A of the seal member 32 may be, for example, set smaller than an radially intermediate diameter R0. Therefore, a portion having a width a between the front-surface radially inner diameter R1 and the front-surface radially outer diameter R2 (portion of the slide surface 32A) is smaller than a portion having a width b between the front-surface radially inner diameter R1 and the radially intermediate diameter R0 (portion of an effective area on the reverse surface 32B side). In addition, the pressure P1 of the effective area on the reverse surface 32B side is higher than the pressure on the slide surface 32 A side. Therefore, the difference between a load Fb on the reverse surface 32B and a load Ff on the slide surface 32A is large and the seal member 32 is strongly pressed toward the backpressure plate 16. Then, the slide surface 32A is rapidly being adapted to the surroundings and its abrasion comparably quickly advances.

FIG. 9 shows the seal member 32 in which the abrasion of the slide surface 32A has advanced to a certain degree. In this state, the area of the slide surface 32A increases toward the outer circumference side, the width a increases, and the front-surface radially outer diameter R2 becomes a little larger than the radially intermediate diameter R0. In this way, when the front-surface radially outer diameter R2 becomes larger than the radially intermediate diameter R0, the difference between the load Fb on the reverse surface 32B and the load Ff on the slide surface 32A decreases, according to increase in the area of the portion with a width C between the front-surface radially outer diameter R2 and the radially intermediate diameter R0, as shown in the first embodiment. As a result, the speed at which an abrasion of the seal member 32 advances is gradually getting slower, since the pressing force of the seal member 32 becomes smaller compared to that under the initial state.

FIG. 7 shows the seal member 32 in which the abrasion of the slide surface 32A has further advanced. In this state, the width a further increases, and the front-surface radially outer diameter R2 becomes considerably larger than the radially intermediate diameter R0. Since the difference between the load Fb on the reverse surface 32B and the load Ff on the slide surface 32A further decreases in this state, the pressing force of the seal member 32 further decreases, and therefore the speed at which an abrasion of the seal member 32 advances becomes extremely slow.

The second embodiment configured as mentioned above can bring about the substantially similar effect to the first embodiment. Particularly, the second embodiment is characterized in that the contact area of the seal member 32 with the backpressure plate 16 increases due to an abrasion of the slide surface 32A of the seal member 32. The seal member 32 includes the inclined portion 32F configured such that the front surface of the seal member 32 is being gradually spaced apart from the backpressure plate 16 as tapering from the slide surface 32A to the low pressure side. Therefore, as the seal member 32 is abrading away, the area of the slide surface 32A of the seal member 32 can increase in the portion receiving only the pressure P2 of the low pressure side on the reverse surface 32B side of the seal member 32 (low-pressure-side extension portion 32E). As a result, as an abrasion of the seal member 32 advances, the pressing force of the seal member 32 gradually decreases finally to a level of not causing further abrasion of the seal member 32. Therefore, it is possible to further extend the lifetime of the seal member 32.

Figure 10:
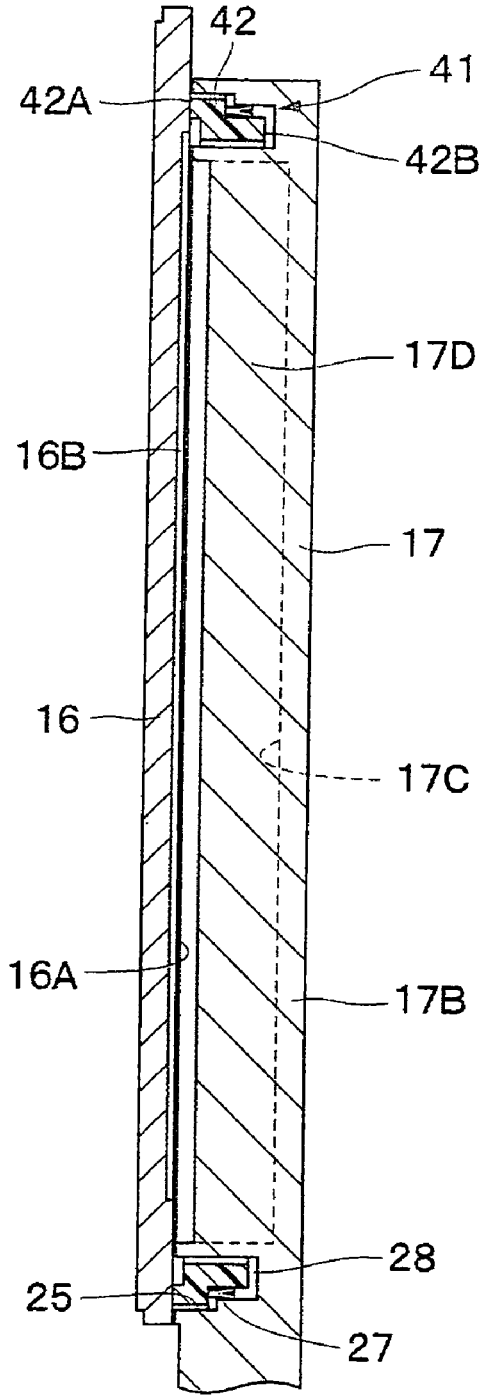
FIG. 10 is an expanded sectional view expanding and illustrating a backpressure plate, a holder, a seal mechanism and the like in a third embodiment.
Figure 11:
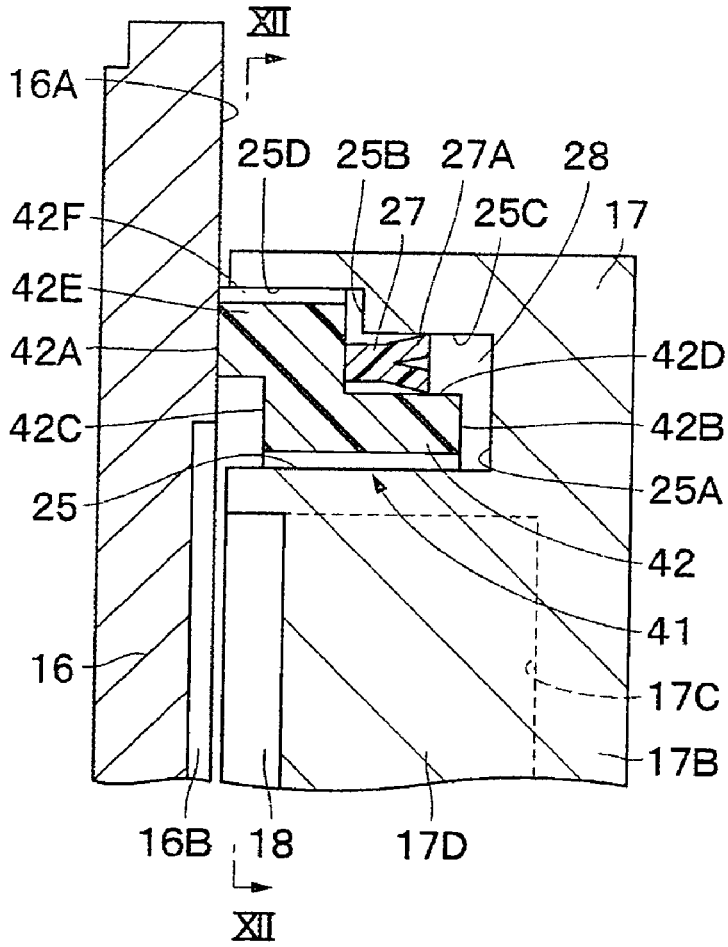
FIG. 11 is an expanded sectional view of main parts, which expands and illustrates the seal mechanism shown in FIG. 10.
Figure 12:
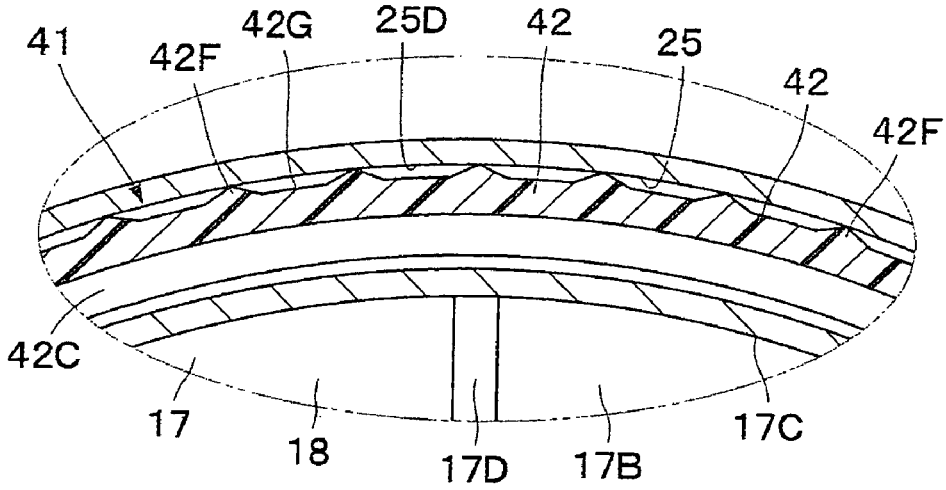
FIG. 12 is an expanded cross-sectional view of main parts, which illustrates the seal member and the like as viewed in the direction of the arrows XII-XII in FIG. 11.

Next, FIGS. 10 to 12 show a third embodiment of the present invention. The third embodiment is characterized in that a seal member includes, on a portion facing a shallow groove peripheral wall of a seal attachment groove on an outer circumference side of the seal member, a raised portion extending in a direction toward a bottom of the groove. In the third embodiment, elements corresponding to the above-described elements of the first embodiment will be assigned the same reference numerals as those used in the first embodiment, and the descriptions thereof will not be made in further detail.

Reference numeral 41 denotes a seal mechanism in the third embodiment, which is disposed between a holder 17 and a backpressure plate 16. The seal mechanism 41 comprises a seal attachment groove 25, a seal member 42, a Y-shaped packing 27 and the like, similarly to the seal mechanism 24 in the first embodiment.

Reference numeral 42 denotes an annular seal member fittedly inserted in the seal attachment groove 25. Substantially similarly to the seal member 26 in the first embodiment, the seal member 42 may be mainly made of a tetrafluoride resin material such as polytetrafluoroethylene (PTFE). The seal member 42 comprises an annular continuous body without any discontinuity around the circumference, and is configured such that radially acting loads thereon are balanced.

Further, substantially similarly to the seal member 26 in the first embodiment, the seal member 42 comprises a slide surface 42A, a reverse surface 42B, a high-pressure-side stepped portion 42C, a cutout portion 42D, and a low-pressure-side extension portion 42E. A first gap S1 is defined between the seal member 42 and a deep groove peripheral wall 25C, and a second gap S2 is defined between the seal member 42 and a shallow groove peripheral wall 25D. The first gap S1 is larger than the second gap S2. A Y-shaped packing 27 is disposed in the first gap S1.

Further, the seal member 42 includes a plurality of raised portions 42F formed on a portion facing the second gap S2. The raised portions 42F extend in the direction toward a bottom of the seal attachment groove 25 (axial direction). The seal member 42 further includes gullet portions formed between the adjacent raised portions 42F. In other words, the raised portions 42F are formed on an outer circumference side of the low-pressure-side extension portion 42E of the seal member 42, which faces the shallow groove peripheral wall 25D of the seal attachment groove 25. The raise portions 42F are provided around the entire circumference of the seal member 42, and surround the outer surface of the seal member 42.

The third embodiment configured as mentioned above can bring about the substantially similar effect to the first embodiment. Particularly, the third embodiment is characterized in that the raised portions 42F extending in the direction toward the bottom of the groove are formed on the outer circumference side of the low-pressure-side extension portion 42E of the seal member 42, which faces the second gap S2. Therefore, even if the seal member 42 is radially displaced, the tips of the raised portions are made abut against the shallow groove peripheral wall 25D of the seal attachment groove 25 so that the presence of the second gap S2 can be ensured. Due to provision of the raised portions 42F of the seal member 42, the pressure P2 of the low pressure side can be easily introduced into the outer circumference side of the seal member 42. In the low-pressure-side extension portion 42E of the seal member 42, the reverse surface 42B side receives only the pressure P2 of the low pressure side, while the slide surface 42A side receives pressures between the pressure P1 of the high pressure side and the pressure P2 of the low pressure side. As a result, in the low-pressure-side extension portion 42E of the seal member 42, the slide surface 42A side receives a higher pressure than the reverse surface 42B side, so that the difference between a load Ff acting on the slide surface 42A of the seal member 42 and a load Fb acting on the reverse surface 42B of the seal member 42 can be securely reduced.

In the third embodiment, raised portions 42F are provided on the outer surface of the seal member 42. However, this does not limit the present invention. In some embodiments, groove-like gullet portions extending in a direction toward a bottom of a shallow groove peripheral wall 25D of a seal attachment groove 25 may be provided. In this case, raised portions may be formed between the adjacent gullet portions, and a pressure of a low pressure side can be introduced into an outer circumference side of the seal member 42 due to provision of the gullet portions.

In the third embodiment, the raised portions 42F and the gullet portions 42G are provided to the seal member 42 which is similar to the seal member 26 in the first embodiment. However, this does not limit the present invention. In some embodiments, raised portions or gullet portions may be provided to, for example, a seal member which is similar to the seal member 32 in the second embodiment.

Figure 13:
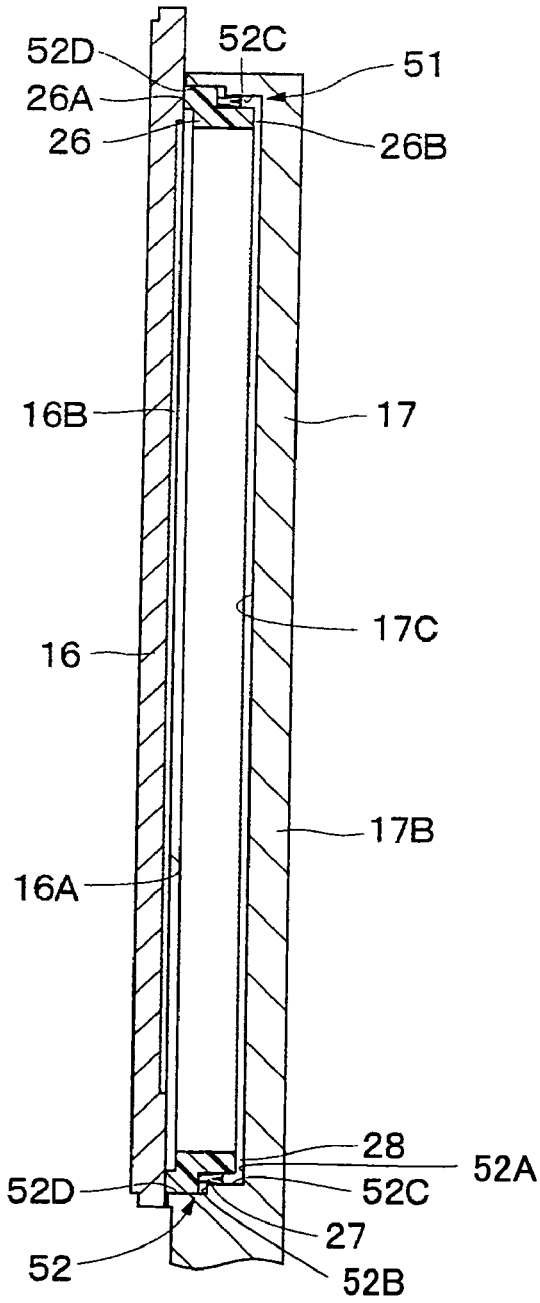
FIG. 13 is an expanded sectional view expanding and illustrating a backpressure plate, a holder, a seal mechanism and the like in a fourth embodiment.

Next, FIG. 13 shows a fourth embodiment of the present invention. The fourth embodiment is characterized in that a seal mechanism includes a circular seal attachment groove including an annular outer circumference side and including an inner circumference side with no peripheral wall. In the fourth embodiment, elements corresponding to the above-described elements of the first embodiment will be assigned the same reference numerals as those used in the first embodiment, and the descriptions thereof will not be made in further detail.

Reference numeral 51 denotes a seal mechanism disposed between a holder 17 and a backpressure plate 16. The seal mechanism 51 comprises a seal attachment groove 52, a seal member 26, a Y-shaped packing 27 and the like, similarly to the seal mechanism 24 in the first embodiment.

Reference numeral 52 denotes a seal attachment groove provided to a bottom plate portion 17B. The seal attachment groove 52 comprises a circular concave having an annular outer circumference side and having an inner circumference side with no peripheral wall. The seal attachment groove 52 is provided on a slide surface of the bottom plate portion 17B, with which the portion 17B slides on the backpressure plate 16, so as to be open to the backpressure plate 16. A bottom portion 52A having a large depth is formed on the inner circumference side of the seal attachment groove 52, and the bottom portion 52A is in communication with a compressed-air-containing portion 17C. On the other hand, the outer circumference side of the seal attachment groove 52 is stepped to define a shallow bottom portion 52B having a shallow depth. Further, on the low pressure side of the seal attachment groove 52, a deep groove peripheral wall 52*c* is formed between the bottom portion 52A and the shallow bottom portion 52B, and a shallow groove peripheral wall 52D is formed between the shallow bottom portion 52B and an opening.

The seal member 26 is fittedly inserted in the seal attachment groove 52, and the Y-shaped packing is attached between the seal attachment groove 52 and the seal member 26. By this arrangement, the seal mechanism 51 airtightly seals an orbiting backpressure chamber 18 positioned on an inner circumference side of the seal member 26 from outside.

The fourth embodiment configured as mentioned above can bring about the substantially similar effect to the first embodiment. When high pressure air is always contained in the orbiting backpressure chamber 18 positioned on the inner circumference side of the seal member 26, and low pressure air is contained in the outer circumference side of the seal member 26 (outside), there is no need for supporting the seal member 26 on the inner circumference side thereof. Therefore, the forth embodiment with use of the seal attachment groove 52 without a peripheral wall on the inner circumference side thereof can bring about the effect similar to the first embodiment.

Figure 14:
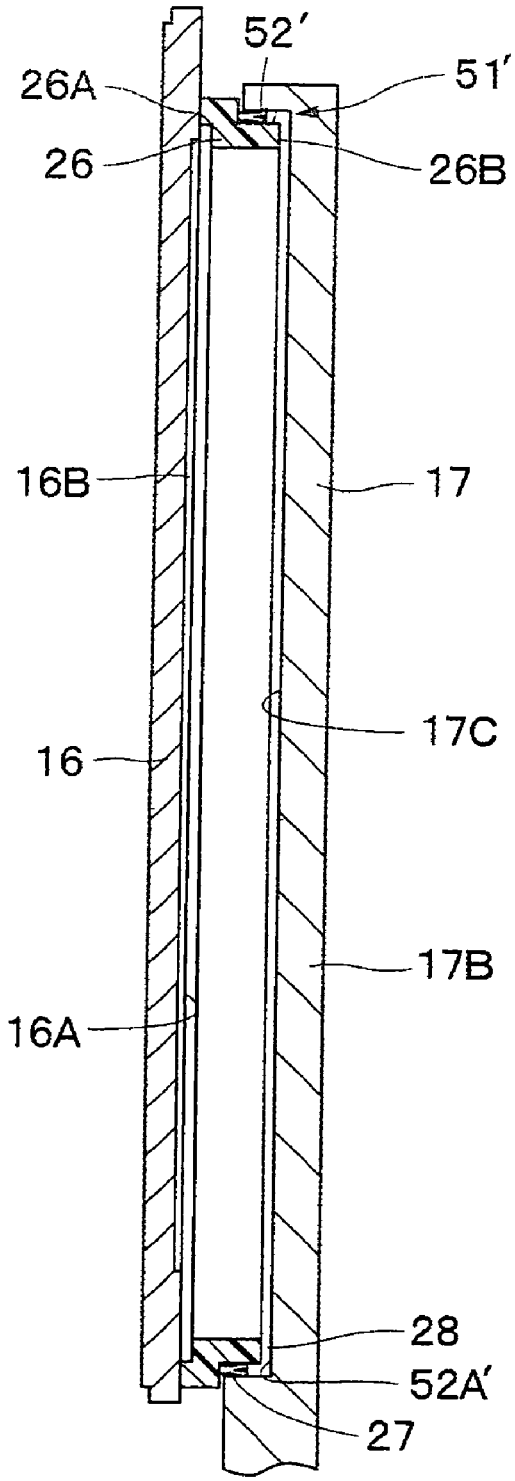
FIG. 14 is an expanded sectional view expanding and illustrating a backpressure plate, a holder, a seal mechanism and the like in a first modification.

In the seal mechanism 51 in the forth embodiment, the seal attachment groove 52 includes the stepped shallow bottom portion 52B. However, this does not limit the present invention. Some embodiments may use a seal attachment groove not having a shallow bottom portion, such as a seal attachment groove 52' in a seal mechanism 51' in a modification of the first embodiment shown in FIG. 14. If a rigid seal member 26 is used, such a seal member 26 is rarely deformed. Therefore, an embodiment with use of the seal attachment groove 52' as described above can also bring about the effect similar to the first embodiment.

Figure 15:
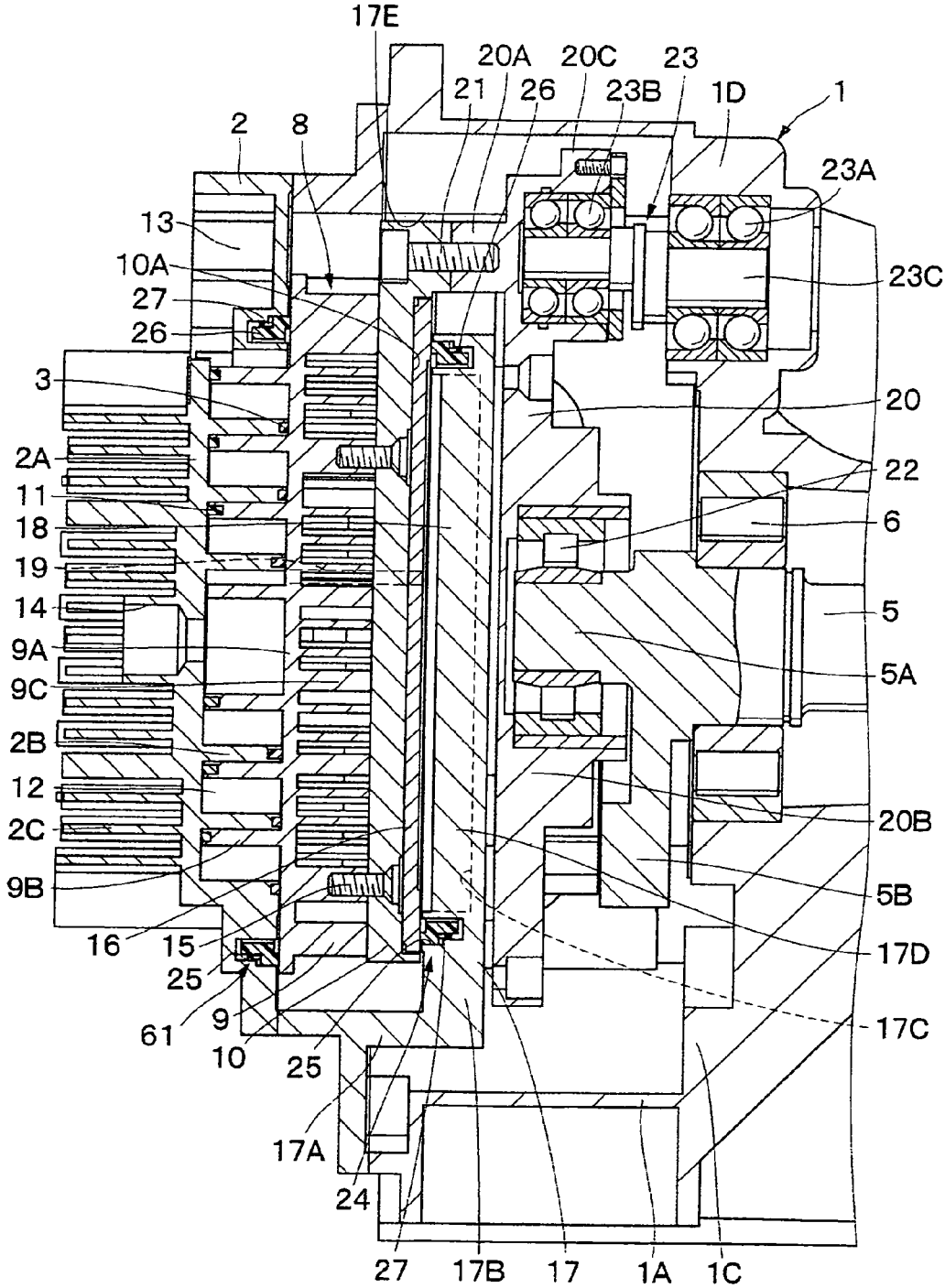
FIG. 15 is an expanded sectional view expanding and illustrating main parts of a booster air compressor according to a fifth embodiment.

Next, FIG. 15 shows a fifth embodiment of the present invention. The fifth embodiment is characterized in that a seal mechanism is disposed between a fixed scroll and an orbiting scroll. In the fifth embodiment, elements corresponding to the above-described elements of the first embodiment will be assigned the same reference numerals as those used in the first embodiment, and the descriptions thereof will not be made in further detail.

Reference numeral 61 denotes a seal mechanism disposed between a fixed scroll 2 and an orbiting scroll 8. The seal mechanism 61 comprises a seal attachment groove 25, a seal member 26, a Y-shaped packing 27 and the like, similarly to the seal mechanism 24 in the first embodiment. The seal attachment groove 25 is provide to the fixed scroll 2 which is stationary by being fixed to the casing 1. The seal attachment groove 25 is positioned on a side of a slide surface of the fixed scroll 2, with which the fixed scroll 2 slides on the orbiting scroll 8, and is provided in an end plate 2A, surrounding compression chambers (wrap portion 2B).

The seal member 26 is fittedly inserted in the seal attachment groove 25, and the Y-shaped packing 27 is attached between the seal attachment groove 25 and the seal member 26. By this arrangement, the seal mechanism 61 airtightly seal the compression chambers 12 positioned on an inner circumference side of the seal member 26 from outside.

The fifth embodiment configured as mentioned above can bring about the substantially similar effect to the first embodiment. A particular advantage of the fifth embodiment is that, since the seal mechanism 61 is disposed in the stationary fixed scroll 2, easiness of assembling and productivity can be improved, compared to an fluid machine in which the seal mechanism is disposed in the orbiting scroll 8 to which an orbiting bearing 22 and the like are attached.

In the fifth embodiment, the seal mechanism 61 similar to the seal mechanism 24 in the first embodiment is disposed between the fixed scroll 2 and the orbiting scroll 8. However, this does not limit the present invention. In some embodiments, for example, a seal mechanism similar to the seal mechanism 31 or 41 in the second or third embodiment may be disposed in a fixed scroll 2 and a orbiting scroll 8.

Figure 16:
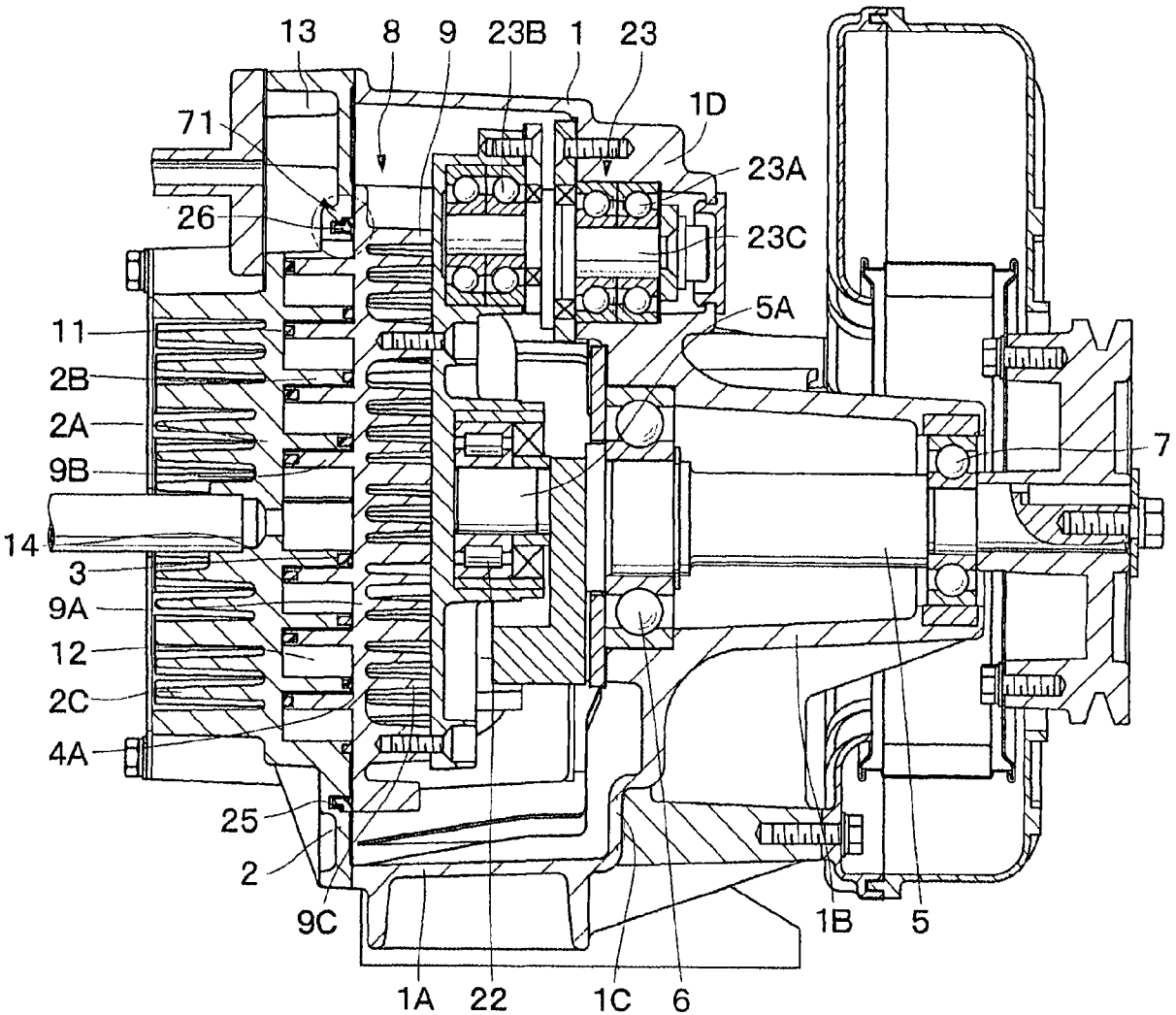
FIG. 16 is a sectional view of a booster air compressor according to a second modification.
Figure 17:
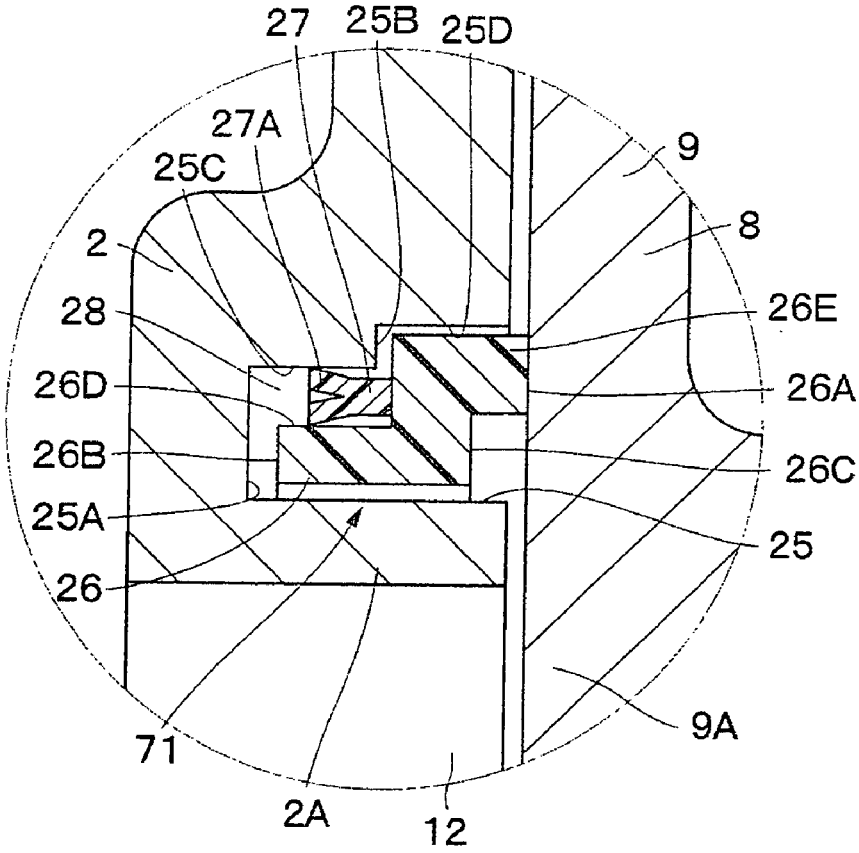
FIG. 17 is an expanded sectional view of main parts, which expands and illustrates the seal mechanism shown in FIG. 16.

In the fifth embodiment, the orbiting backpressure chamber 18 is formed on a reverse surface side of the orbiting scroll 8. In some embodiments, as in a second modification shown in FIGS. 16 and 17, a seal mechanism 71 may be disposed between a fixed scroll 2 and an orbiting scroll 8 in a booster compressor or a scroll expander which does not have an orbiting backpressure chamber. In this case, an orbiting bearing 22 and an auxiliary crank mechanism 23 may be attached on a reverse surface side of the orbiting scroll 8. The seal mechanism 71 may be, for example, similar to any one of the seal mechanisms 24, 31 and 41 in the first, second and third embodiments.

Figure 18:
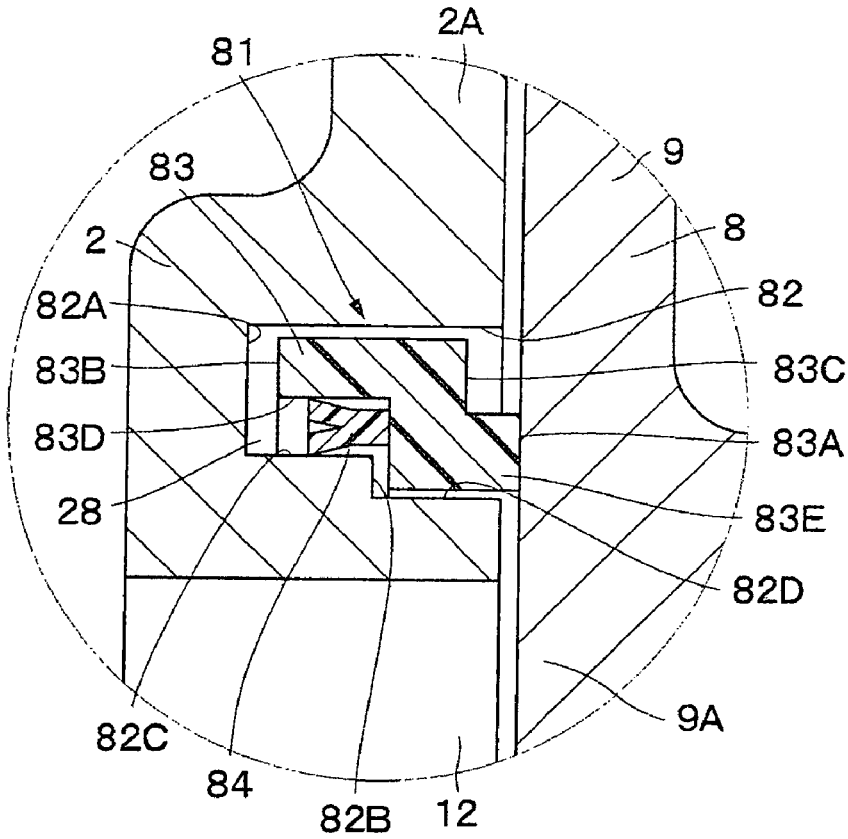
FIG. 18 is an expanded sectional view of main parts, which illustrates the same part of a seal mechanism in a third modification as that shown in FIG. 17.

When a scroll type fluid machine is used as a vacuum pump, for example, a seal mechanism 81, which has a reverse configuration to the seal mechanism 24 in the first embodiment in terms of inner circumference side and outer circumference side, may be disposed in a fixed scroll 2 and an orbiting scroll 8, as in a third modification shown in FIG. 18.

In this case, sealed chambers 12 defined between a wrap portion 2B of the fixed scroll 2 and a wrap portion 9B of the orbiting scroll 8 contains air having lower pressure than that of outside. Therefore, although a seal attachment groove 82, similarly to the seal attachment groove 25, includes a bottom portion 82A, a shallow bottom portion 82B, a deep groove peripheral wall 82C and a shallow groove peripheral wall 82D, the shallow bottom portion 82B, the deep groove peripheral wall 82C and the shallow groove peripheral wall 82D are disposed on an inner circumference side of the seal attachment groove 82.

The seal member 83, similarly to the seal member 26, comprises a slide surface 83A, a reverse surface 83B, a high-pressure-side stepped portion 83C, a cutout portion 83D and a low-pressure-side extension portion 83E. However, the high-pressure-side stepped portion 83C is provided on an outer circumference side of the seal member 83, and the cutout portion 83D and the low-pressure-side extension portion 83E are provided on an inner circumference side of the seal member 83. A Y-shaped packing 84 is attached between the inner circumference side of the seal member 83 and the deep groove peripheral wall 82C of the seal attachment groove 82.

In the embodiments discussed above, the Y-shaped packing 27 or 84 having a Y-shaped cross section is used as a leak prevention means. In some embodiments, a V-shaped packing having a V-shaped cross section or a U-shaped packing having a U-shaped cross section may be used. In other embodiments, a leak prevention means may comprise an O-ring attached to a cutout portion provided on a bottom portion or a peripheral wall of a seal attachment groove.

In the embodiments discussed above, the seal members 26, 32, 42 and 83 respectively include the high-pressure-side stepped portions 26C, 32C, 42C and 83C. In some embodiments, a high-pressure-side stepped portion may not be provided, and a seal member may have a L-shaped cross section without a high-pressure-side stepped portion.

In the embodiments discussed above, the seal members 26, 32, 42 and 83 are formed using a material mainly made of PTFE. However, in the present invention, a material used for a seal member is not limited to this kind. In some embodiments, a seal member may be formed using, for example, a resin composite made of a material other than PTFE.

In the embodiments discussed above, the fixed scroll 2, the orbiting scroll 8, the backpressure plate 16 and the holder 17 are formed using a member in which an alumite treatment is performed on an aluminum material. In some embodiments, a fixed scroll, an orbiting scroll, a backpressure plate and a holder may be formed using another material.

In the first to fourth embodiments discussed above, the seal attachment grooves 25, 25, 52 and 52' are provided on the holder 17 on the casing 1 side, not on the backpressure plate 16 on the orbiting scroll 8 side. However, this does not limit the present invention. In some embodiments, for example, a seal attachment groove may be provide on a backpressure plate 16, and a seal member fittedly inserted in the seal attachment groove may be made in sliding contact with a planate slide surface of the holder 17.

In the fifth embodiment discussed above, the seal attachment groove 25, 82 is provided on the end plate 2A of the fixed scroll 2, not on the end plate 9A of the orbiting scroll 8. However, this does not limit the present invention. In some embodiments, for example, a seal attachment groove may be provided on an end plate 9A of an orbiting scroll 8, and a seal member fittedly inserted in the seal attachment groove may be made in sliding contact with a planate end plate of a fixed scroll 2.

Although the embodiments have been discussed taking as an example the scroll type fluid machine in which the orbiting scroll 8 performs an orbiting motion to the fixed scroll 2 fixed to the casing 1 for better understanding of the present invention, it should be understood that the present invention is not limited to these embodiments. For example, the present invention may be employed in a two-scrolls-rotation-type scroll fluid machine in which two scrolls disposed so as to face each other are respectively driven to rotate, as disclosed in Japanese Patent Publication H09-133087.

Although the embodiments have been discussed taking a scroll compressor, a scroll expander, a vacuum pump or others as an example of a scroll type fluid machine, the present invention is not limited to these embodiments and may be employed in more wide-range machinery including a refrigerant compressor or others.

Although the embodiments employing the seal mechanisms 24, 31, 41, 51, 51', 61, 71 and 81 as a seal system for a scroll type fluid machine have been discussed above, the present invention is not limited to these embodiments and may be employed in more wide-range machinery or others. For example, the present invention may be employed in any machinery in which, while a sliding motion is performed between two components facing each other, a sealed chamber or the like containing fluid with a pressure different from an outside pressure is defined between the two components.

As described above, according to the embodiments of the present invention, the seal member is configured such that, when the seal member is in a used state, the contact area of the slide surface of the seal member with the member on the one side is large compared to the effective area of the backpressure side of the seal member which pushes the seal member toward the member on the one side. The term "effective area of the backpressure side of the seal member" is used to denote a difference between areas of the one side member side and the other side member side on which the pressure of the high pressure side of the seal member directly acts. The term "used state" is used to denote a state in which the seal member has slid to the member on the one side and has adapted to the surroundings. Therefore, "used state" includes a state in which the contact area of the slide surface of the seal member with the member on the one side may be equal to or smaller than the effective area of the backpressure side of the seal member at first, but the contact area of the slide surface of the seal member with the member on the one side becomes larger than the effective area of the backpressure side of the seal member after the seal member has abraded and has adapted to the surroundings. Since the pressure of the high pressure side acts on the effective area of the backpressure side of the seal member, the load (pressing load) obtained by integrating the pressure of the high pressure side acts on the effective area on the reverse surface side of the seal member. On the other hand, since the pressures (distributed pressures) consecutively distributed in the range of the low pressure side pressure to the high pressure side pressure act on the contact area of the seal member with the member on the one side, the load obtained by integrating the distributed pressures acts on the contact area on the slide surface side of the seal member. Because the contact area of the slide surface of the seal member with the member on the one side is large compared to the effective area of the backpressure side of the seal member, it is possible to reduce a difference between the load from the pressure acting on the slide surface of the seal member and the load from the pressure acting on the reverse surface of the seal member. As a result, it becomes possible to reduce the pressing force of the seal member even when a pressure of sealed fluid is high. Therefore it becomes possible to decrease a rate of abrasion of the seal member and to extend the lifetime of the seal member, thereby improving reliability and durability thereof.

When the seal member is in a used state, the slide surface of the seal member extends radially toward the low pressure side relative to the boundary of the low pressure side of the backpressure chamber. In the low-pressure-side extension portion of the seal member, which extends toward the low pressure side beyond the boundary of the low pressure side of the backpressure chamber, while the pressure of the low pressure side acts on the reverse side thereof, the pressures distributed between the low pressure side pressure and the high pressure side pressure act on the slide surface (contact surface) thereof. Therefore, in the low-pressure-side extension portion of the seal member, the slide surface side receives a higher pressure than the reverse surface side does. Due to the provision of the low-pressure-side extension portion of the seal member, the contact area of the slide surface of the seal member with the member on the one side becomes large compared to the effective area of the backpressure side of the seal member. Therefore, it is possible to reduce the difference between the load from the pressure acting on the slide surface of the seal member and the load from the pressure acting on the reverse surface of the seal member. As a result, it becomes possible to reduce the pressing force of the seal member even when a pressure of sealed air is high. Therefore it becomes possible to decrease a rate of abrasion of the seal member and to extend the lifetime of the seal member, thereby improving reliability and durability.

Since the seal member comprises a continuous body without any discontinuity around the circumference, even though a pressure difference exists between the inner surface and the outer surface of the seal member, the seal member is not affected by the pressure difference, and is prevented from expanding. In addition, since radially acting loads are balanced on the seal member alone, the seal member is not radially displaced, and is thereby prevented from being pushed against the peripheral wall of the groove. Therefore, a movement of the seal member is not restrained by friction between the seal member and the peripheral wall of the groove, and there is no advancement of abrasion, whereby a reliability and durability of the seal member is improved.

Since the seal member is configured such that loads acting in a direction (radial direction) perpendicular to the peripheral wall of the groove are balanced thereon, the seal member is not radially displaced, thereby being prevented from being pushed against the peripheral wall of the groove. Therefore, movement of the seal member is not restrained by friction between the seal member and the peripheral wall of the groove, and there is no advancement of abrasion, whereby a reliability and durability of the seal member can be improved.

When the seal member is configured such that the contact area with the member on the one side increases due to an abrasion of the slide surface of the seal member, as shown in the second embodiment, the area of the slide surface of the seal member can be increased in the portion in which only the pressure of the low pressure side acts on the reverse surface side of the seal member, for example, as the seal member is abrading away. As abrasion of the seal member advances, the pressing load of the seal member can be reduced. Therefore, it is possible to reduce the pressing load of the seal member to such a degree as to prevent further abrasion, and therefore to further extend the lifetime of the seal member.

In this case, since the seal member includes a portion which is gradually being spaced apart from the member on the one side as tapering from the slide surface to the low pressure side, it is possible that, due to abrasion of the slide surface of the seal member, the area of the slide surface of the seal member can be increased in the portion in which only the pressure of the low pressure side acts on the reverse surface side of the seal member. Therefore, it is possible to reduce the pressing load of the seal member as abrasion of the seal member advances, and therefore to further extend the lifetime of the seal member.

According to the embodiments discussed above, the seal member includes, on the high pressure side of the slide surface, the high-pressure-side stepped portion which faces the member on the one side in a spaced-apart relationship with the member on the one side. By this arrangement, the pressure of the high pressure side acts on between the high-pressure-side stepped portion and the member on the one side. Therefore, the force acting on the reverse surface of the seal member can be offset with the force acting on the high-pressure-side stepped portion, so that it is possible to reduce the effective area of the backpressure side of the seal member, and thereby to reduce the pressing load of the seal member.

In the embodiments discussed above, since a leak prevention means is disposed between the deep groove peripheral wall on the low pressure side of the groove and the cutout portion of the seal member, the high pressure side pressure acting on the reverse surface of the seal member can be prevented from leaking into the low pressure side due to the leak prevention means.

In the embodiments discussed above, the first gap defined between the seal member and the deep groove peripheral wall on the low pressure side of the groove is larger than the second gap defined between the seal member and the shallow peripheral wall of the low pressure side of the groove. By this arrangement, even if the seal member is radially displaced, the second gap disappears before the first gap disappears. Therefore, the presence of the first gap can be always ensured, so that any packing disposed in the first gap as a leak prevention means can be prevented from being compressed to become flattened.

In the embodiments discussed above, since the leak prevention means is disposed in the first gap, the high pressure side pressure acting on the reverse surface of the seal member can be prevented from leaking into the low pressure side due to the provision of the leak prevention means.

If a raised or gullet portion extending toward the bottom of the groove is formed on the portion of the seal member which faces the second gap, as shown in the third embodiment, the pressure of the low pressure side can be easily introduced through the second gap due to the provision of the raised or gullet portion of the seal member.

According to the above-discussed embodiments of present invention, either of the member on the one side or the member on the other side can be configured to perform an orbiting motion. Therefore, a seal system according to the present invention can be employed in a scroll type fluid machine in which, for example, two scrolls overlap and an orbiting motion is performed therebetween.

In the embodiments discussed above, the member on the one side and the member on the other side are formed using a member in which an alumite treatment is performed on an aluminum material, and the seal member is mainly made of polytetrafluoroethylene. Since the seal member is mainly made of a polytetrafluoroethylene material which has excellent lubricating properties and anti-abrasion properties, reliability and durability of the seal member can be further improved.

In a scroll type fluid machine according to the present invention, when the seal member is in a used state, the above-mentioned effect of the seal member can be obtained, since the seal member is configured such that the slide surface of the seal member extends radially toward the low pressure side beyond the boundary of the low pressure side of the backpressure chamber. Therefore, even when a significant pressure difference exists between the outside and the sealed chamber between the two scrolls, it is possible to seal the sealed chamber from the outside with use of the seal mechanism, and also it is possible to maintain the excellent seal function of the seal mechanism over a long period of time.

In the fifth embodiment, a scroll on the one side is an orbiting scroll which performs an orbiting motion, and a scroll on the other side is a stationary fixed scroll. Therefore, the seal mechanism can be provided to the stationary fixed scroll, and ease of assembly and productivity can be improved as compared to a scroll type fluid machine in which a seal mechanism is provided to an orbiting scroll to which an orbiting bearing and the like are attached.

Since the seal member is configured such that the slide surface of the seal member extends radially toward the low pressure side beyond the boundary of the low pressure side of the backpressure chamber when the seal member is in a used state, an effect similar to the above-mentioned scroll type fluid machine can be obtained. Therefore, even when a significant pressure difference exists between the orbiting backpressure chamber and the outside, it is possible to seal the orbiting backpressure chamber from the outside by using the seal mechanism, and also it is possible to maintain the excellent seal function of the seal mechanism over a long period of time.

When the seal member is configured such that the contact area with the orbiting scroll increases due to abrasion of the slide surface of the seal member as shown in the second embodiment, the area of the slide surface of the seal member can be increased in the portion in which only the pressure of the low pressure side acts on the reverse surface side of the seal member, for example, as the seal member is abrading away. As the abrasion of the seal member advances, the pressing load of the seal member can be reduced. Therefore, it is possible to reduce the pressing load of the seal member to such a degree that no further abrasion is caused, and therefore to further extend the lifetime of the seal member.

In this case, since the seal member includes a portion which is gradually spaced apart from the member on the one side as tapering from the slide surface to the low pressure side, it is possible that, due to abrasion of the slide surface of the seal member, the area of the slide surface of the seal member can be increased in the portion in which only the pressure of the low pressure side acts on the reverse surface side of the seal member. Therefore, it is possible to reduce the pressing load of the seal member as an abrasion of the seal member advances, and therefore to further extend the lifetime of the seal member.

In a scroll type fluid machine according to the present invention, the seal member includes, on the high pressure side of the slide surface, the high-pressure-side stepped portion which faces the member on the one side in a spaced-apart relationship with the member on the one side. By this arrangement, the pressure of the high pressure side acts on between the high-pressure-side stepped portion and the member on the one side. Therefore, the force acting on the reverse surface of the seal member can be offset with the force acting on the high-pressure-side stepped portion, so that it is possible to reduce the effective area of the backpressure side of the seal member, and thereby to reduce the pressing load of the seal member.

Since the leak prevention means is disposed between the deep groove peripheral wall on the low pressure side of the groove and the cutout portion of the seal member, the high pressure side pressure acting on the reverse surface of the seal member can be prevented from leaking into the low pressure side due to the provision of the leak prevention means.

The first gap defined between the seal member and the deep groove peripheral wall on the low pressure side of the groove is larger than the second gap defined between the seal member and the shallow peripheral wall on the low pressure side of the groove. By this arrangement, even if the seal member is radially displaced, the second gap disappears before the first gap does. Therefore, the presence of the first gap can be always ensured, and even when the high-pressure-side stepped portion of the seal member is formed to extend as high as near the first gap for example, the effective area of the backpressure side of the seal member can be securely obtained so that it is possible to press the seal member against the member on the one side.

In a scroll type fluid machine according to the present invention, the orbiting scroll and the fixed scroll are formed using a member in which an alumite treatment is performed on an aluminum material, and the seal member is mainly made of polytetrafluoroethylene. Since the seal member is mainly made of a polytetrafluoroethylene material which has excellent lubricating properties and anti-abrasion properties, reliability and durability of the seal member can be further improved.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The present application claims priority under 35 U.S.C. section 119 to Japanese Patent Application No. 2007-50577, filed on Feb. 28, 2007. The entire disclosure of Japanese Patent Application No. 2007-50577, filed on Feb. 28, 2006 including specification, claims, drawings and summary is incorporated herein by reference in its entirety.

The Japanese Patent Application Public Disclosures No. 2005-61304, 2004-301093, H01-250675 are incorporated herein by reference in its entirety.

What is claimed is:

1. A seal system comprising:

a first member disposed on one side and a second member disposed on another side, which members face each other, and at least one of which performs a sliding motion;

an annular groove provided on a slide surface of the second member, the slide surface being a surface with which the second member slides on the first member; and an annular seal member fittedly inserted in the groove and having a surface used as a slide surface; wherein, the slide surface of the seal member contacts a slide surface of the first member on their flat surfaces;

a high pressure side and a low pressure side are defined, said high pressure side being disposed on an inner or outer peripheral side of said seal member and said low pressure side being disposed on a side opposite the high pressure side of said seal member;

a leak preventer for preventing a pressure of the high pressure side from leaking into the low pressure side is disposed between the seal member and the groove;

the leak preventer, a bottom portion side of the groove and the seal member define a backpressure chamber that is in communication with the high pressure side; and when the seal member is in operation, a contact area of the slide surface of the seal member with the first member is large compared to an effective area of the backpressure side of the seal member which pushes the seal member toward the first member, which effective area is defined as a difference between an area of the seal member on the slide surface side, on which a pressure from the high pressure side acts, and an area of the seal member on a side of said second member, on which a pressure from the high pressure side acts.

2. The seal system according to claim 1, wherein the slide surface of the seal member is configured such that the contact area of the slide surface of the seal member with the first member increases due to abrasion of the slide surface of the seal member.

3. The seal system according to claim 1, wherein the slide surface of the seal member includes a portion which is gradually spaced apart relative to the first member from the slide surface of the seal member toward the low pressure side.

4. The seal system according to claim 1, wherein the seal member includes, on the high pressure side of the slide surface thereof, a high-pressure-side stepped portion facing the first member, in a spaced-apart relationship with the first member.

5. The seal system according to claim 1, wherein:

a shallow bottom portion having a lesser depth than that of the bottom portion of the groove is formed on the low pressure side of the groove;

a cutout portion configured to match the shallow bottom portion is formed on the seal member; and the leak preventer is disposed between the cutout portion of the seal member and a low-pressure-side deep groove peripheral wall positioned between the bottom portion and the shallow bottom portion of the groove.

6. The seal system according to claim 5, wherein:

a low-pressure-side shallow groove peripheral wall positioned between the shallow bottom portion of the groove and an opening is formed; and a first gap defined between the seal member and the low-pressure-side deep groove peripheral wall of the groove is larger than a second gap defined between the seal member and the low-pressure-side shallow groove peripheral wall of the groove.

7. The seal system according to claim 6, wherein a raised or gullet portion extending in a direction toward the bottom portion is formed on a portion of the seal member, the portion facing the second gap.

8. A seal system comprising:

a first member disposed on one side and a second member disposed on another side, which members face each other, and at least one of which performs a sliding motion;

an annular groove provided on a slide surface of the second member, the slide surface being a surface with which the second member slides on the first member; and an annular seal member fittedly inserted in the groove and having a surface used as a slide surface; wherein, the slide surface of the seal member contacts a slide surface of the first member on their flat surfaces;

a high pressure side and a low pressure side are defined, said high pressure side being disposed on an inner or outer peripheral side of said seal member, and said low pressure side being disposed on a side opposite to the high pressure side of said seal member;

a leak preventer for preventing a pressure of the high pressure side from leaking into the low pressure side is disposed between the seal member and the groove, so as to be positioned on the low pressure side on an inner circumference side or an outer circumference side of the seal member;

the leak preventer, a bottom portion side of the groove and the seal member define a backpressure chamber that is in communication with the high pressure side; and when the seal member is in operation, the slide surface of the seal member extends radially toward the low pressure side relative to a boundary between a part of a surface of said seal member on a side of the second member on which a pressure from the low pressure side acts, and a part on which a pressure from the high pressure side acts.

9. The seal system according to claim 8, wherein the slide surface of the seal member is configured such that a contact area of the slide surface of the seal member with the first member increases due to abrasion of the slide surface of the seal member.

10. The seal system according to claim 8, wherein the slide surface of the seal member includes a portion which is gradually spaced apart relative to the first member from the slide surface of the seal member toward the low pressure side.

11. The seal system according to claim 8, wherein the seal member includes, on the high pressure side of the slide surface thereof, a high-pressure-side stepped portion facing the first member, in a spaced-apart relationship with the first member.

12. The seal system according to claim 8, wherein:

a shallow bottom portion having a lesser depth than that of the bottom portion of the groove is formed on the low pressure side of the groove;

a cutout portion configured to match the shallow bottom portion is formed on the seal member; and the leak preventer is disposed between the cutout portion of the seal member and a low-pressure-side deep groove peripheral wall positioned between the bottom portion and the shallow bottom portion of the groove.

13. The seal system according to claim 12, wherein:

a low-pressure-side shallow groove peripheral wall positioned between the shallow bottom portion of the groove and an opening is formed; and a first gap defined between the seal member and the low-pressure-side deep groove peripheral wall of the groove is larger than a second gap defined between the seal member and the low-pressure-side shallow groove peripheral wall of the groove.

14. The seal system according to claim 13, wherein a raised or gullet portion extending in a direction toward the bottom portion is formed on a portion of the seal member, the portion facing the second gap.

15. A scroll type fluid machine wherein:

a wrap portion of a first scroll disposed on one side and a wrap portion of a second scroll disposed on another side overlap to define a sealed chamber;

fluid drawn or introduced from outside is compressed or expanded while an orbiting motion is performed;

a seal mechanism comprises an annular groove provided on a periphery side of the wrap portion of the second scroll, and an annular seal member fittedly inserted in the groove and having a surface used as a slide surface;

in the seal mechanism, the slide surface of the seal member contacts a slide surface of the first scroll on their flat surfaces, and a high pressure side and a low pressure side are defined;

a leak preventer for preventing a ptessure of the high pressure side from leaking into the low pressure side is disposed between the seal member and the groove so as to be positioned on the low pressure side on an inner circumference side or an outer circumference side of the seal member;

the leak preventer, a bottom portion side of the groove and the seal member define a backpressure chamber in communication with the high pressure side; and when the seal member is in operation, the slide surface of the seal member extends radially toward the low pressure side relative to a boundary between a part of a surface of said seal member on a side of the second scroll on which a pressure from the low pressure side acts and a part on which a pressure from the high pressure side acts.

16. A scroll type fluid machine comprising:

a casing;

a fixed scroll disposed in the casing and having a spiral wrap portion extending from a surface of an end plate thereof; and an orbiting scroll disposed so as to face the fixed scroll and having a wrap portion which extends from a surface of an end plate thereof and overlaps with the wrap portion of the fixed scroll to define a plurality of sealed chambers therebetween; wherein, a backpressure chamber defining member which defines an orbiting backpressure chamber that pushes the orbiting scroll toward the fixed scroll is disposed in the casing so as to be positioned on a reverse surface of the orbiting scroll;

a seal mechanism for sealing the orbiting backpressure chamber from outside is provided on an outer or inner circumference side of the orbiting backpressure chamber;

the seal mechanism comprises an annular groove provided on a slide surface of the backpressure chamber defining member, with which the backpressure chamber defining member slides on the orbiting scroll, and an annular seal member fittedly inserted in the groove and having a surface used as a slide surface;

the slide surface of the seal member contacts a slide surface of the orbiting scroll on their flat surfaces;

the orbiting backpressure chamber on a high pressure side and outside on a low pressure side are defined;

a leak preventer for preventing a pressure of the high pressure side from leaking into the low pressure side is disposed between the seal member and the groove so as to be positioned on the low pressure side on an inner or outer circumference side of the seal member;

the leak preventer, a bottom portion side of the groove and the seal member define a backpressure chamber in communication with the orbiting backpressure chamber on the high pressure side; and when the seal member is in operation, the slide surface of the seal member extends radially toward the low pressure side relative to a boundary between a part of a surface of said seal member on a side of the fixed scroll on which a pressure from the low pressure side acts, and a part on which a pressure from the high pressure side acts.

17. The scroll type fluid machine according to claim 16, wherein the slide surface of the seal member is configured such that a contact area of the slide surface of the seal member with the orbiting scroll increases due to abrasion of the slide surface of the seal member.

18. The scroll type fluid machine according to claim 16, wherein the slide surface of the seal member includes a portion which is gradually being spaced apart relative to the orbiting scroll from the slide surface of the seal member toward the low pressure side.

19. The scroll type fluid machine according to claim 16, wherein the seal member includes, on the high pressure side of the slide surface thereof, a high-pressure-side stepped portion facing the orbiting scroll in a spaced-apart relationship with the orbiting scroll.

20. The scroll type fluid machine according to claim 16, wherein:

a shallow bottom portion having a shallower depth than that of the bottom portion of the groove is formed on the low pressure side of the groove;

a cutout portion configured to match the shallow bottom portion is formed on the seal member; and the leak preventer is disposed between the cutout portion of the seal member and a low-pressure-side deep groove peripheral wall positioned between the bottom portion and the shallow bottom portion of the groove.

21. The scroll type fluid machine according to claim 20, wherein a low-pressure-side shallow groove peripheral wall positioned between the shallow bottom portion of the groove and an opening is formed; and a first gap defined between the seal member and the low-pressure-side deep groove peripheral wall of the groove is larger than a second gap defined between the seal member and the low-pressure-side shallow groove peripheral wall of the groove.

22. The scroll type fluid machine according to claim 16, wherein the fixed scroll and the orbiting scroll are formed with use of a member in which an alumite treatment is performed on an aluminum material, and the seal member is mainly made of polytetrafluoroethylene.

* * * * *